US010255837B2

(12) United States Patent
Yata et al.

(10) Patent No.: US 10,255,837 B2
(45) Date of Patent: Apr. 9, 2019

(54) IMAGE DISPLAY DEVICE

(71) Applicant: Japan Display Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 182 days.

(21) Appl. No.: 14/955,668

(22) Filed: Dec. 1, 2015

(65) Prior Publication Data

US 2016/0163249 A1 Jun. 9, 2016

(30) Foreign Application Priority Data

Dec. 3, 2014 (JP) ..... 2014-244919

(51) Int. Cl.

*G09G 3/20* (2006.01)
*G09G 3/3225* (2016.01)
*G09G 3/3233* (2016.01)

(52) U.S. Cl.

CPC ..... *G09G 3/2003* (2013.01); *G09G 3/3225* (2013.01); *G09G 3/3233* (2013.01); *G09G 2300/0452* (2013.01); *G09G 2300/0842* (2013.01); *G09G 2320/0666* (2013.01); *G09G 2340/06* (2013.01)

(58) Field of Classification Search

CPC ..... G09G 3/3233; G09G 2300/0452; G09G 2300/0842; G09G 2340/06
USPC ..... 345/604, 694
See application file for complete search history.

(56) References Cited

U.S. PATENT DOCUMENTS

| | | | | |
|---|---|---|---|---|
| 7,012,588 | B2 | 3/2006 | Siwinski | |
| 7,091,941 | B2 | 8/2006 | Arnold et al. | |
| 8,203,572 | B2 | 6/2012 | Park et al. | |
| 2003/0034992 | A1 | 2/2003 | Brown Elliott et al. | |
| 2003/0227429 | A1 | 12/2003 | Shimoshikiryo | |
| 2005/0099426 | A1* | 5/2005 | Primerano | G09G 3/3208 345/589 |
| 2005/0206979 | A1 | 9/2005 | Tomizawa et al. | |
| 2010/0085281 | A1* | 4/2010 | Yokota | G02F 1/13624 345/76 |

(Continued)

FOREIGN PATENT DOCUMENTS

| | | | |
|---|---|---|---|
| JP | 2004-062146 | A | 2/2004 |
| JP | 2005227408 | A | 8/2005 |

(Continued)

OTHER PUBLICATIONS

Japanese Office Action dated Aug. 14, 2018 for corresponding Japanese Patent Application No. 2014-244919.

*Primary Examiner* — Stacy Khoo
(74) *Attorney, Agent, or Firm* — Michael Best & Friedrich LLP

(57) ABSTRACT

According to an aspect, an image display device includes: first pixels each including sub-pixels of three or more colors included in a first color gamut; second pixels each including sub-pixels of three or more colors, the sub-pixels in the second pixels having luminance higher than the luminance of the sub-pixels in the first pixels, the three or more colors belonging to a second color gamut within the first color gamut; and an image display unit in which the first pixels and the second pixels are arranged in a matrix in a display area, the first pixels and the second pixels being adjacent to each other.

13 Claims, 25 Drawing Sheets

(56) References Cited

U.S. PATENT DOCUMENTS

| | | | | |
|---|---|---|---|---|
| 2011/0043535 | A1* | 2/2011 | Kwiatkowski | G06T 11/001 345/604 |
| 2011/0242149 | A1 | 10/2011 | Yoshida et al. | |
| 2013/0235094 | A1* | 9/2013 | Cok | G09G 5/02 345/694 |
| 2014/0313244 | A1* | 10/2014 | Yang | G09G 5/10 345/694 |
| 2015/0077640 | A1 | 3/2015 | Kanda | |

FOREIGN PATENT DOCUMENTS

| | | | | | |
|---|---|---|---|---|---|
| JP | 2005227586 | A | | 8/2005 | |
| JP | 2006221007 | A | | 8/2006 | |
| JP | 2007514184 | A | | 5/2007 | |
| JP | 2010072353 | A | | 4/2010 | |
| JP | 2010187416 | A | | 8/2010 | |
| JP | 2010211098 | A | | 9/2010 | |
| JP | 2010237697 | A | | 10/2010 | |
| JP | 2011221112 | A | | 11/2011 | |
| JP | 2013121041 | A | * | 6/2013 | G02B 27/2214 |
| JP | 2013182149 | A | | 9/2013 | |
| WO | 02091349 | A1 | | 11/2002 | |
| WO | 2005048232 | A1 | | 5/2005 | |
| WO | 2010067581 | A1 | | 6/2010 | |
| WO | 2012067037 | A1 | | 5/2012 | |
| WO | 2012067038 | A1 | | 5/2012 | |

* cited by examiner

IMAGE DISPLAY DEVICE

CROSS-REFERENCE TO RELATED APPLICATIONS

This application claims priority from Japanese Application No. 2014-244919, filed on Dec. 3, 2014, the contents of which are incorporated by reference herein in its entirety.

BACKGROUND

1. Technical Field

The present invention relates to an image display device.

2. Description of the Related Art

In the related art, developed are display devices including an image display panel that lights a self-luminous body such as an organic light-emitting diode (OLED) (for example, refer to Japanese Translation of PCT Application No. 2007-514184). The display device includes an image display panel that lights a self-luminous body in which an additional primary color of a pixel W (white) is added to sub-pixels of three primary colors, that is, a pixel R (red), a pixel G (green), and a pixel B (blue). In this display device, when an input image having low saturation is displayed on the image display panel, an input signal can be replaced with a color output signal of four colors including the additional primary color W, so that power consumption of the display device can be reduced.

With the image display panel including the self-luminous body in the related art, a multiple primary color system is implemented using sub-pixels such as W (white), C (cyan), M (magenta), and Y (yellow) in addition to sub-pixels of three primary colors including R (red), G (green), and B (blue), which can further reduce the power consumption. However, when the multiple primary color system is implemented in the image display panel, the number of pixels of the image display panel is increased. Accordingly, higher density of arrangement of the pixels may be required, and a data conversion algorithm for obtaining an optimal solution from the input signal may be complicated.

For the foregoing reasons, there is a need for an image display device capable of reducing power consumption without increasing the number of pixels.

SUMMARY

According to an aspect, an image display device includes: first pixels each including sub-pixels of three or more colors included in a first color gamut; second pixels each including sub-pixels of three or more colors, the sub-pixels in the second pixels having luminance higher than the luminance of the sub-pixels in the first pixels, the three or more colors belonging to a second color gamut within the first color gamut; and an image display unit in which the first pixels and the second pixels are arranged in a matrix in a display area, the first pixels and the second pixels being adjacent to each other.

According to another aspect, an image display device includes: first pixels each including sub-pixels of three or more colors included in a first color gamut; second pixels each including sub-pixels of three or more colors, the sub-pixels in the second pixels having luminance higher than the luminance of the sub-pixels in the first pixels, the three or more colors being included in a second color gamut within the first color gamut; an image display unit in which the first pixels and the second pixels are arranged in a matrix, the first pixels and the second pixels being adjacent to each other; and a signal processing unit that determines an output of the sub-pixels included in each pixel of the image display unit according to an input image signal.

DETAILED DESCRIPTION

Figure 1:
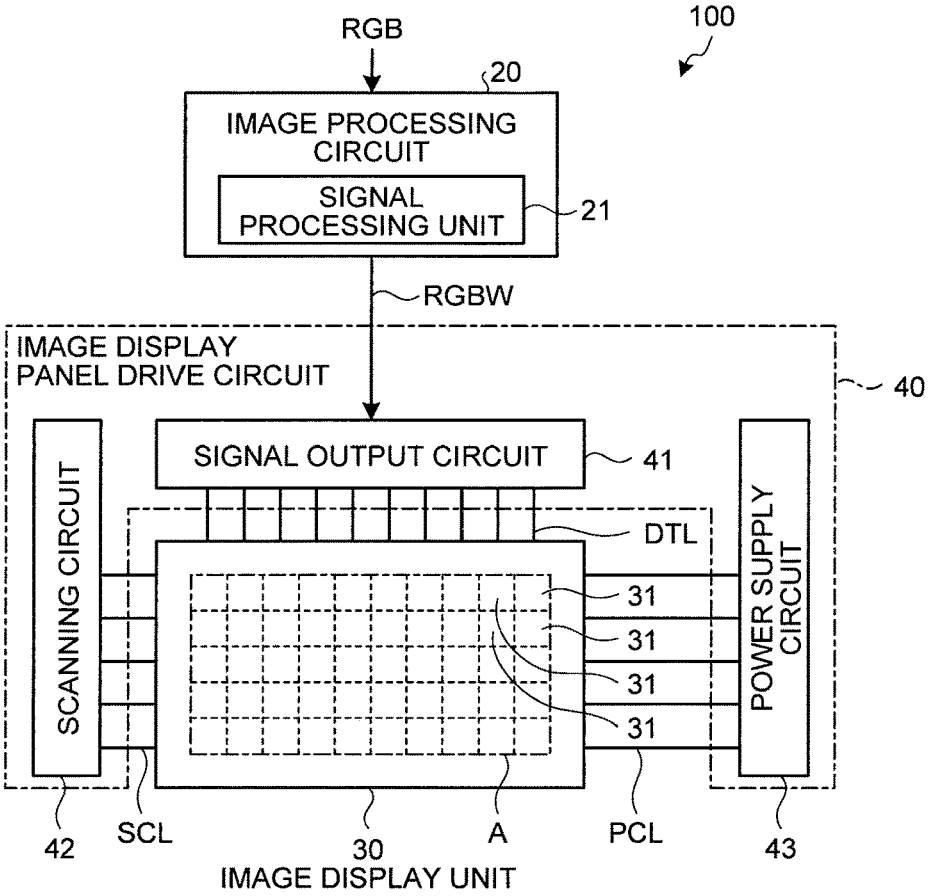
FIG. 1 is a block diagram illustrating an example of a configuration of an image display device according to an embodiment.

The following describes an embodiment of the present invention with reference to the drawings. The disclosure is merely an example, and the present invention naturally encompasses appropriate modifications maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same elements as those described in the drawings that have already been discussed are denoted by the same reference signs throughout the description and the drawings, and detailed description thereof will not be repeated in some cases.

Configuration of Image Display Device

Figure 2:
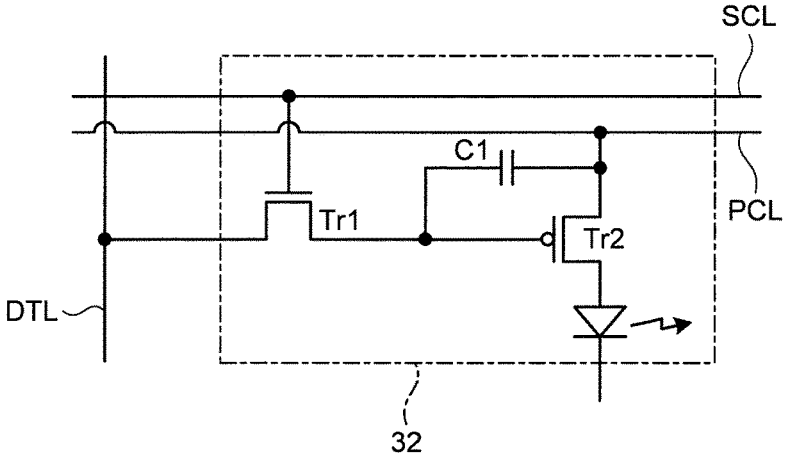
FIG. 2 is a diagram illustrating a lighting drive circuit of a sub-pixel included in a pixel of an image display unit according to the embodiment.
Figure 3:
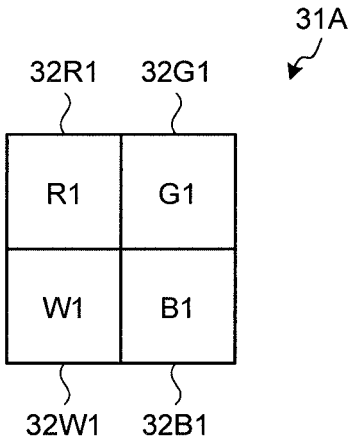
FIG. 3 is a diagram illustrating an array of sub-pixels of a first pixel according to the embodiment.
Figure 4:
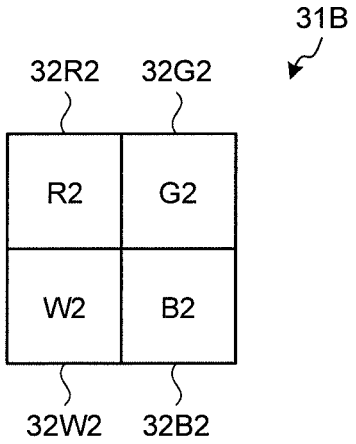
FIG. 4 is a diagram illustrating an array of sub-pixels of a second pixel according to the embodiment.
Figure 5:
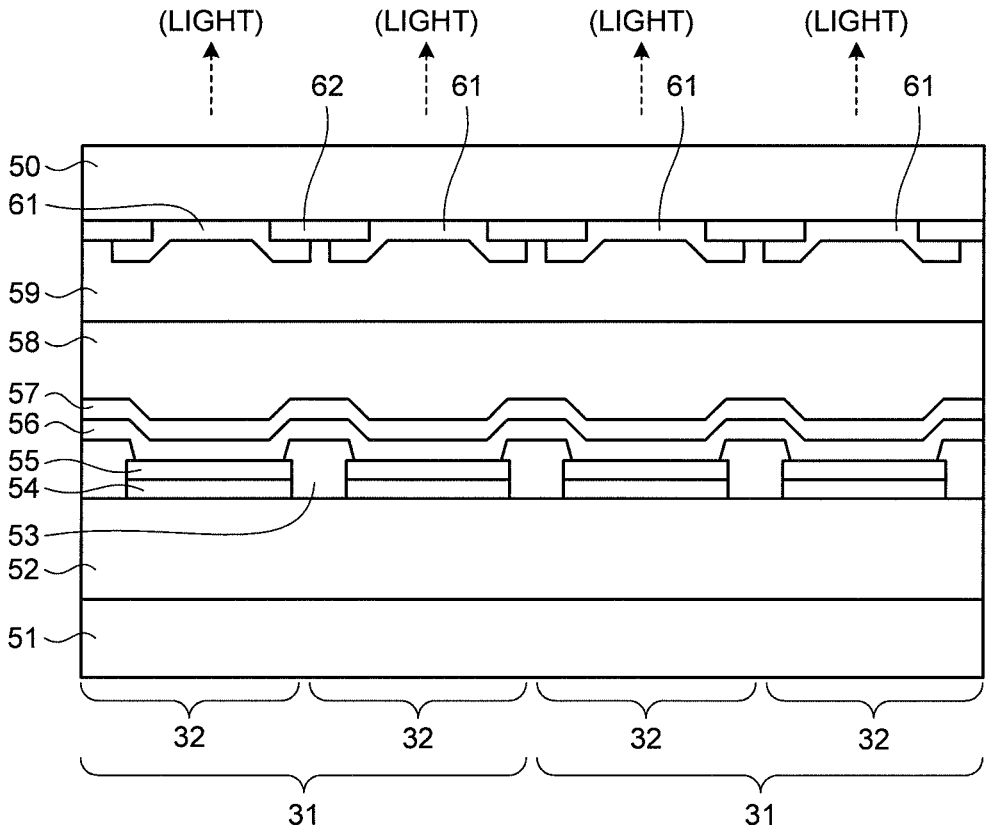
FIG. 5 is a diagram illustrating a sectional structure of the image display unit according to the embodiment.

FIG. 1 is a block diagram illustrating an example of a configuration of an image display device 100 according to the embodiment. FIG. 2 is a diagram illustrating a lighting drive circuit of a sub-pixel 32 included in a pixel 31 of an image display unit 30 according to the embodiment. FIG. 3 is a diagram illustrating an array of sub-pixels 32 of a first pixel 31A according to the embodiment. FIG. 4 is a diagram illustrating an array of sub-pixels 32 of a second pixel 31B according to the embodiment. FIG. 5 is a diagram illustrating a sectional structure of the image display unit 30 according to the embodiment.

As illustrated in FIG. 1, the image display device 100 includes an image processing circuit 20, the image display unit 30 serving as an image display panel, and an image display panel drive circuit 40 (hereinafter, also referred to as a drive circuit 40) that controls driving of the image display unit 30. A function of the image processing circuit 20 may be implemented as hardware or software, and is not limited.

The image processing circuit 20 is coupled to the image display panel drive circuit 40 for driving the image display unit 30. The image processing circuit 20 includes a signal processing unit 21. The signal processing unit 21 determines an output of the sub-pixels 32 (described later) included in each pixel 31 of the image display unit 30 corresponding to an input image signal. For example, the signal processing unit 21 converts the input image signal of an RGB color space into an extended value of RGBW that is expressed with four colors. The signal processing unit 21 outputs the generated output signal to the image display panel drive circuit 40. In this case, the output signal is a signal indicating an output (light emitting state) of the sub-pixels 32 included in the pixel 31.

The drive circuit 40 is a control device, and includes a signal output circuit 41, a scanning circuit 42, and a power supply circuit 43. The drive circuit 40 sequentially outputs an output signal to each pixel 31 of the image display unit 30 with the signal output circuit 41. The signal output circuit 41 is electrically coupled to the image display unit 30 via a signal line DTL. The drive circuit 40 for the image display unit 30 selects the sub-pixels 32 in the image display unit 30 with the scanning circuit 42, and controls ON and OFF of a switching element (for example, a thin film transistor (TFT)) for controlling operation of the sub-pixels 32. The scanning circuit 42 is electrically coupled to the image display unit 30 via a scanning line SCL. The power supply circuit 43 supplies electric power to a self-luminous body (described later) of each pixel 31 via a power supply line PCL.

The image display unit 30 includes a display area A in which $P_0 \times Q_0$ pixels 31 ($P_0$ in a row direction, and $Q_0$ in a column direction) are arranged in a two-dimensional matrix (rows and columns). The image display unit 30 according to the embodiment includes a polygonal (for example, rectangular) planar display area having linear sides. However, this shape is merely an example of a specific shape of the display area A. The embodiment is not limited thereto, and can be appropriately modified.

The pixel 31 includes the first pixel 31A including sub-pixels of three or more colors included in a first color gamut, and the second pixel 31B including sub-pixels of three or more colors included in a second color gamut within the first color gamut. When it is not necessary to distinguish the first pixel 31A from the second pixel 31B, they are collectively referred to as the pixel 31. The pixel 31 includes a plurality of sub-pixels 32, and lighting drive circuits of the sub-pixels 32 illustrated in FIG. 2 are arrayed in a two-dimensional matrix (rows and columns). The lighting drive circuit includes a control transistor Tr1, a driving transistor Tr2, and a charge holding capacitor C1. A gate of the control transistor Tr1 is coupled to the scanning line SCL, a source thereof is coupled to the signal line DTL, and a drain thereof is coupled to a gate of the driving transistor Tr2. One end of the charge holding capacitor C1 is coupled to the gate of the driving transistor Tr2, and the other end thereof is coupled to a source of the driving transistor Tr2. The source of the driving transistor Tr2 is coupled to the power supply line PCL, and a drain of the driving transistor Tr2 is coupled to an anode of an organic light-emitting diode serving as the self-luminous body. A cathode of the organic light-emitting diode is coupled to, for example, a reference potential (for example, a ground). In the example of FIG. 2, the control transistor Tr1 is an n-channel transistor, and the driving transistor Tr2 is a p-channel transistor. However, polarities of the transistors are not limited thereto. The polarity of each of the control transistor Tr1 and the driving transistor Tr2 may be determined as needed.

As illustrated in FIG. 3, the first pixel 31A includes, for example, a first sub-pixel 32R1 (hereinafter, also simply referred to as "R1" in the drawings), a second sub-pixel 32G1 (hereinafter, also simply referred to as "G1" in the drawings), a third sub-pixel 32B1 (hereinafter, also simply referred to as "B1" in the drawings), and a fourth sub-pixel 32W1 (hereinafter, also simply referred to as "W1" in the drawings). The first sub-pixel 32R1 displays a first primary color (for example, a red (R) component). The second sub-pixel 32G1 displays a second primary color (for example, a green (G) component). The third sub-pixel 32B1 displays a third primary color (for example, a blue (B) component). The fourth sub-pixel 32W1 displays a fourth color (white (W) in this embodiment) as an additional color component different from the first primary color, the second primary color, and the third primary color. As described above, three colors among the colors of the sub-pixels 32 included in the first pixel 31A correspond to red, green, and blue. For example, the first sub-pixel 32R1, the second sub-pixel 32G1, the third sub-pixel 32B1, and the fourth sub-pixel 32W1 are arranged in two rows and two columns (2×2) in the first pixel 31A.

As illustrated in FIG. 4, the second pixel 31B includes, for example, a fifth sub-pixel 32R2 (hereinafter, also simply referred to as "R2" in the drawings), a sixth sub-pixel 32G2 (hereinafter, also simply referred to as "G2" in the drawings), a seventh sub-pixel 32B2 (hereinafter, also simply referred to as "B2" in the drawings), and an eighth sub-pixel 32W2 (hereinafter, also simply referred to as "W2" in the drawings). The fifth sub-pixel 32R2 displays the first primary color (for example, the red (R) component). The sixth sub-pixel 32G2 displays the second primary color (for example, the green (G) component). The seventh sub-pixel 32B2 displays the third primary color (for example, the blue (B) component). The eighth sub-pixel 32W2 displays the fourth color (white (W) in the embodiment) as an additional color component different from the first primary color, the second primary color, and the third primary color. For example, the fifth sub-pixel 32R2, the sixth sub-pixel 32G2, the seventh sub-pixel 32B2, and the eighth sub-pixel 32W2 are arranged in two rows and two columns (2×2) in the second pixel 31B. In the embodiment, the luminance of the fifth sub-pixel 32R2 is higher than that of the first sub-pixel 32R1, the luminance of the sixth sub-pixel 32G2 is higher than that of the second sub-pixel 32G1, and the luminance of the seventh sub-pixel 32B2 is higher than that of the third sub-pixel 32B1.

As described above, the number of the sub-pixels 32 included in the first pixel 31A is the same as the number of the sub-pixels 32 included in the second pixel 31B in the embodiment. In the embodiment, the colors of the sub-pixels 32 included in one of the first pixel 31A and the second pixel 31B (for example, the second pixel 31B) are the same as the colors of the sub-pixels 32 included in the other pixel (first pixel 31A). The relation described above is merely an example of a relation between the first pixel 31A and the second pixel 31B. The relation is not limited thereto and can be appropriately modified. For example, the number of the sub-pixels 32 included in the first pixel 31A may be different from the number of the sub-pixels 32 included in the second pixel 31B. The luminance of the sub-pixels 32 included in the first pixel 31A may be higher than the luminance of the sub-pixels 32 included in the second pixel 31B. When it is not necessary to distinguish the first sub-pixel 32R1, the second sub-pixel 32G1, the third sub-pixel 32B1, the fourth sub-pixel 32W1, the fifth sub-pixel 32R2, the sixth sub-pixel 32G2, the seventh sub-pixel 32B2, and the eighth sub-pixel 32W2 from each other, they are collectively referred to as the sub-pixels 32.

As illustrated in FIG. 5, the image display unit 30 includes a substrate 51, insulating layers 52 and 53, a reflective layer 54, a lower electrode 55, a self-luminous layer 56, an upper electrode 57, insulating layers 58 and 59, a color filter 61 serving as a color conversion layer, a black matrix 62 serving as a light shielding layer, and a substrate 50. Examples of the substrate 51 include, but are not limited to, a semiconductor substrate made of silicon and the like, a glass substrate, and a resin substrate. The substrate 51 is provided with or holds the lighting drive circuit and the like described above. The insulating layer 52 is a protective film that protects the lighting drive circuit and the like described above, and may be made of silicon oxide, silicon nitride, and the like. The lower electrode 55 is provided to each of the first sub-pixel 32R1, the second sub-pixel 32G1, the third sub-pixel 32B1, the fourth sub-pixel 32W1, the fifth sub-pixel 32R2, the sixth sub-pixel 32G2, the seventh sub-pixel 32B2, and the eighth sub-pixel 32W2, and is an electric conductor serving as the anode (positive pole) of the organic light-emitting diode described above. The lower electrode 55 is a translucent electrode made of a translucent conductive material (translucent conductive oxide) such as indium tin oxide (ITO). The insulating layer 53 is called a bank, and partitions the first sub-pixel 32R1, the second sub-pixel 32G1, the third sub-pixel 32B1, the fourth sub-pixel 32W1, the fifth sub-pixel 32R2, the sixth sub-pixel 32G2, the seventh sub-pixel 32B2, and the eighth sub-pixel 32W2. The reflective layer 54 is made of a material having metallic luster that reflects light from the self-luminous layer 56, for example, made of silver, aluminum, and gold. The self-luminous layer 56 includes an organic material, and includes a hole injection layer, a hole transport layer, a light-emitting layer, an electron transport layer, and an electron injection layer, which are not illustrated.

Hole Transport Layer

As a layer that generates a positive hole, for example, preferably used is a layer including an aromatic amine compound and a substance that exhibits an electron accepting property for the compound. In this case, the aromatic amine compound is a substance having an arylamine skeleton. Among the aromatic amine compounds, especially preferred is a compound that contains triphenylamine in the skeleton thereof and has a molecular weight of 400 or more. Among the aromatic amine compounds containing triphenylamine in the skeleton thereof, especially preferred is a compound containing a condensed aromatic ring such as a naphthyl group in the skeleton thereof. Heat resistance of a light-emitting element is improved by using the aromatic amine compound containing triphenylamine and a condensed aromatic ring in the skeleton thereof. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N,N-di(m-tolyl)amino]benzene (abbreviated as m-MTDAB), 4,4',4"-tris(N-carbazolyl)triphenylamine (abbreviated as TCTA), 2,3-bis(4-diphenylaminophenyl)quinoxaline (abbreviated as TPAQn), 2,2',3,3'-tetrakis(4-diphenylaminophenyl)-6,6'-bisquinoxaline (abbreviated as D-TriPhAQn), and 2,3-bis{4-[N-(1-naphthyl)-N-phenylamino]phenyl}-dibenzo[f,h]quinoxaline (abbreviated as NPADiBzQn). The substance that exhibits the electron accepting property for the aromatic amine compound is not limited. Examples of the substance include, but are not limited to, molybdenum oxides, vanadium oxides, 7,7,8,8-tetracyanoquinodimethane (abbreviated as TCNQ), and 2,3,5,6-tetrafluoro-7,7,8,8-tetracyano-quinodimethane (abbreviated as F4-TCNQ).

Electron Injection Layer, Electron Transport Layer

An electron transport substance is not limited. Examples of the electron transport substance include, but are not limited to, a metal complex such as tris(8-quinolinolato) aluminum (abbreviated as $Alq_3$), tris(4-methyl-8-quinolinolato)aluminum (abbreviated as $Almq_3$), bis(10-hydroxybenzo[h]-quinolinato)beryllium (abbreviated as $BeBq_2$), bis (2-methyl-8-quinolinolato)-4-phenylphenolato-aluminum (abbreviated as BAlq), bis[2-(2-hydroxyphenyl)benzoxazolato]zinc (abbreviated as $Zn(BOX)_2$), and bis[2-(2-hydroxyphenyl)benzothiazolato]zinc (abbreviated as $Zn(BTZ)_2$). Examples thereof also include, but are not limited to, 2-(4-biphenylyl)-5-(4-tert-butylphenyl)-1,3,4-oxadiazole (abbreviated as PBD), 1,3-bis[5-(p-tert-butylphenyl)-1,3,4-oxadiazol-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), and bathocuproine (abbreviated as BCP). A substance that exhibits an electron donating property for the electron transport substance is not limited. Examples of the substance include, but are not limited to, an alkali metal such as lithium and cesium, an alkaline-earth metal such as magnesium and calcium, and a rare earth metal such as erbium and ytterbium. A substance selected from an alkali metal oxide and an alkaline-earth metal oxide such as lithium oxide ($Li_2O$), calcium oxide (CaO), sodium oxide ($Na_2O$), potassium oxide ($K_2O$), and magnesium oxide (MgO) may be used as the substance that exhibits the electron donating property for the electron transport substance.

Light Emitting Layer

To obtain red-based light emission, a substance exhibiting light emission that has a peak of emission spectrum in a range from 600 nm to 680 nm may be used. Examples of the substance exhibiting the red-based light emission include, but are not limited to, 4-dicyanomethylene-2-isopropyl-6-[2-(1,1,7,7-tetramethyljulolidine-9-yl)ethenyl]-4H-pyran (abbreviated as DCJTI), 4-dicyanomethylene-2-methyl-6-[2-(1,1,7,7-tetramethyljulolidine-9-yl)ethenyl]-4H-pyran (abbreviated as DCJT), 4-dicyanomethylene-2-tert-butyl-6-[2-(1,1,7,7-tetramethyljulolidine-9-yl)ethenyl]-4H-pyran (abbreviated as DCJTB), periflanthene, and 2,5-dicyano-1,4-bis[2-(10-methoxy-1,1,7,7-tetramethyljulolidine-9-yl) ethenyl]benzene. To obtain green-based light emission, a substance exhibiting light emission that has a peak of emission spectrum in a range from 500 nm to 550 nm may be used. Examples of the substance exhibiting the green-based light emission include, but are not limited to, N,N'-dimethylquinacridone (abbreviated as DMQd), coumarin 6, coumarin 545T, and tris(8-quinolinolato)aluminum (abbreviated as $Alq_3$). To obtain blue-based light emission, a substance exhibiting light emission that has a peak of emission spectrum in a range from 420 nm to 500 nm may be used. Examples of the substance exhibiting the blue-based light emission include, but are not limited to, 9,10-bis(2-naphthyl)-tert-butylanthracene (abbreviated as t-BuDNA), 9,9'-bianthryl, 9,10-diphenylanthracene (abbreviated as DPA), 9,10-bis(2-naphthyl)anthracene (abbreviated as DNA), bis(2-methyl-8-quinolinolato)-4-phenylphenolato-gallium (abbreviated as BGaq), and bis(2-methyl-8-quinolinolato)-4-phenylphenolato-aluminum (abbreviated as BAlq). In addition to the substance that emits fluorescence as described above, a substance that emits phosphorescence can also be used as a light-emitting substance. Examples of the substance that emits phosphorescence include, but are not limited to, bis[2-(3,5-bis(trifluoromethyl)phenyl)pyridinato-N,C2']iridium(III)picolinate (abbreviated as $Ir(CF_3ppy)_2(pic)$), bis[2-(4,6-difluorophenyl) pyridinato-N,C2']iridium(III)acetylacetonate (abbreviated as FIr(acac)), bis[2-(4,6-difluorophenyl)pyridinato-N,C2'] iridium(III)picolinate (abbreviated as FIr(pic)), and tris(2-phenylpyridinato-N,C2')iridium (abbreviated as $Ir(ppy)_3$).

The upper electrode 57 is a translucent electrode made of a translucent conductive material (translucent conductive oxide) such as indium tin oxide (ITO). In the embodiment, ITO is exemplified as the translucent conductive material, but the translucent conductive material is not limited thereto. As the translucent conductive material, a conductive material having another composition such as indium zinc oxide (IZO) may be used. The upper electrode 57 serves as the cathode (negative pole) of the organic light-emitting diode. The insulating layer 58 is a sealing layer that seals the upper electrode 57 described above. As the insulating layer 58, silicon oxide, silicon nitride, and the like may be used. The insulating layer 59 is a planarization layer that prevents unevenness from being generated due to the bank. As the insulating layer 59, silicon oxide, silicon nitride, and the like may be used. The substrate 50 is a translucent substrate that protects the entire image display unit 30. For example, a glass substrate may be used as the substrate 50.

In the example of FIG. 5, the lower electrode 55 serves as the anode (positive pole) and the upper electrode 57 serves as the cathode (negative pole). However, the embodiment is not limited thereto. The lower electrode 55 may serve as the cathode and the upper electrode 57 may serve as the anode. In this case, the polarity of the driving transistor Tr2 electrically coupled to the lower electrode 55 can be appropriately changed. A stacking order of a carrier injection layer (the hole injection layer and the electron injection layer), a carrier transport layer (the hole transport layer and the electron transport layer), and the light-emitting layer can also be appropriately changed.

The image display unit 30 is a color display panel and includes the color filter 61 arranged between the sub-pixels 32 and an image observer for transmitting light of colors corresponding to the colors of the sub-pixels 32 among light-emitting components of the self-luminous layer 56. The image display unit 30 can emit light of colors corresponding to red (R), green (G), blue (B), and white (W). The color filter 61 is not necessarily arranged between the image observer and each of the fourth sub-pixel 32W1 and the eighth sub-pixel 32W2 corresponding to white (W). In the image display unit 30, the light-emitting component of the self-luminous layer 56 can emit each color of the first sub-pixel 32R1, the second sub-pixel 32G1, the third sub-pixel 32B1, the fourth sub-pixel 32W1, the fifth sub-pixel 32R2, the sixth sub-pixel 32G2, the seventh sub-pixel 32B2, and the eighth sub-pixel 32W2 without using the color conversion layer such as the color filter 61. In this case, in the image display unit 30, at least some of the sub-pixels 32 may be arranged via color filters 61 of colors corresponding to the sub-pixels 32 such that the color filter 61 is arranged between the first sub-pixel 32R1 and the image observer, and the color filter 61 is not arranged between the fifth sub-pixel 32R2 and the image observer, for example. For example, in the image display unit 30, a transparent resin layer may be provided to the fourth sub-pixel 32W1 and the eighth sub-pixel 32W2 in place of the color filter 61 for color adjustment. In this way, the image display unit 30 can prevent a large gap from being generated above the fourth sub-pixel 32W1 and the eighth sub-pixel 32W2 by providing the transparent resin layer.

According to the embodiment, in the image display unit 30, the color filter 61 that transmits red (R) color is arranged between the observer and each of the first sub-pixel 32R1 and the fifth sub-pixel 32R2, the color filter 61 that transmits green (G) color is arranged between the observer and each of the second sub-pixel 32G1 and the sixth sub-pixel 32G2, and the color filter 61 that transmits blue (B) color is arranged between the observer and each of the third sub-pixel 32B1 and the seventh sub-pixel 32B2. In this case, transmittance of the color filter 61 arranged between the fifth sub-pixel 32R2 and the observer is designed to be higher than that of the color filter 61 arranged between the first sub-pixel 32R1 and the observer, the transmittance of the color filter 61 arranged between the sixth sub-pixel 32G2 and the observer is designed to be higher than that of the color filter 61 arranged between the second sub-pixel 32G1 and the observer, and the transmittance of the color filter 61 arranged between the seventh sub-pixel 32B2 and the observer is designed to be higher than that of the color filter 61 arranged between the third sub-pixel 32B1 and the observer.

Figure 6:
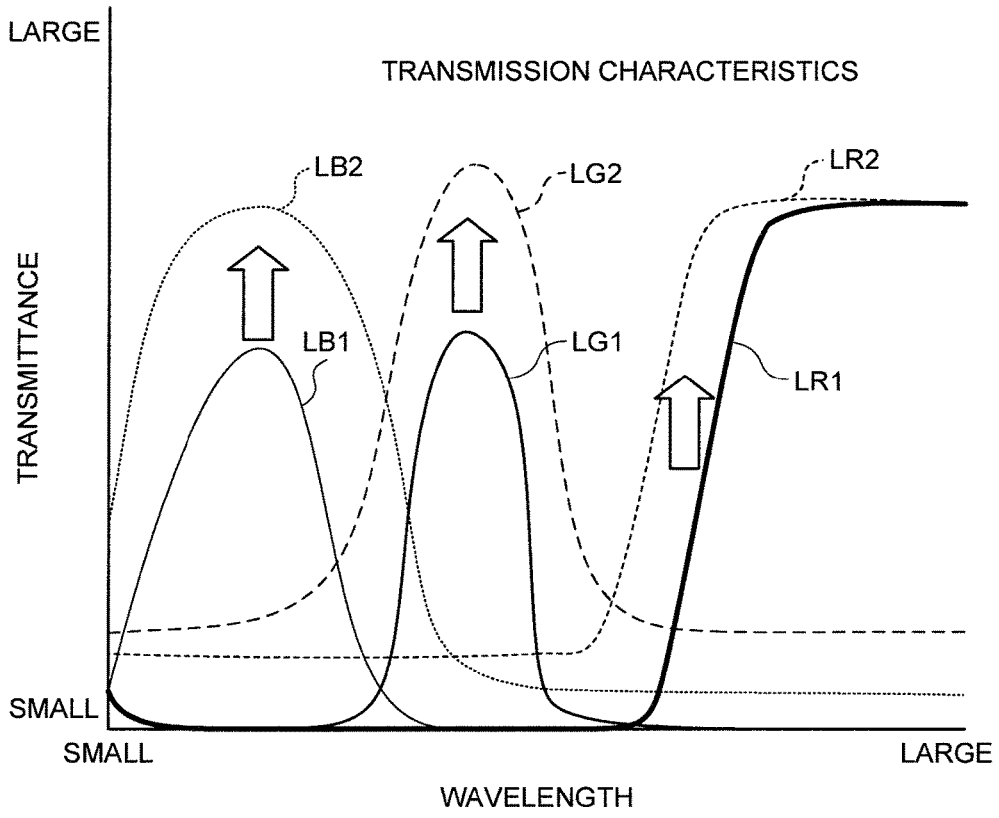
FIG. 6 is a graph illustrating a transmittance curve of a color filter.

The following describes transmission characteristics of the color filter 61. FIG. 6 is a graph illustrating a transmittance curve of the color filter 61. In FIG. 6, the horizontal axis indicates a wavelength and the vertical axis indicates the transmittance. In the embodiment, as described above, the color filter 61 having the transmittance higher than that of the color filter 61 arranged between the observer and each of the first sub-pixel 32R1, the second sub-pixel 32G1, and the third sub-pixel 32B1 of the first pixel 31A is arranged between the observer and each of the fifth sub-pixel 32R2, the sixth sub-pixel 32G2, and the seventh sub-pixel 32B2 of the second pixel 31B. Accordingly, as illustrated in FIG. 6, the transmittance (curve LR2) of a red region of the color filter 61 arranged between the fifth sub-pixel 32R2 and the observer becomes higher than the transmittance (curve LR1) of the red region of the color filter 61 arranged between the first sub-pixel 32R1 and the observer; the transmittance (curve LG2) of a green region of the color filter 61 arranged between the sixth sub-pixel 32G2 and the observer becomes higher than the transmittance (curve LG1) of the green region of the color filter 61 arranged between the second sub-pixel 32G1 and the observer; and the transmittance (curve LB2) of a blue region of the color filter 61 arranged between the seventh sub-pixel 32B2 and the observer becomes higher than the transmittance (curve LB1) of the blue region of the color filter 61 arranged between the third sub-pixel 32B1 and the observer. As evident from above, by using the color filter 61 having high transmittance, the transmittance of the sub-pixels 32 belonging to the second pixel 31B is improved and utilization efficiency of emitted light is significantly improved.

Figure 7:
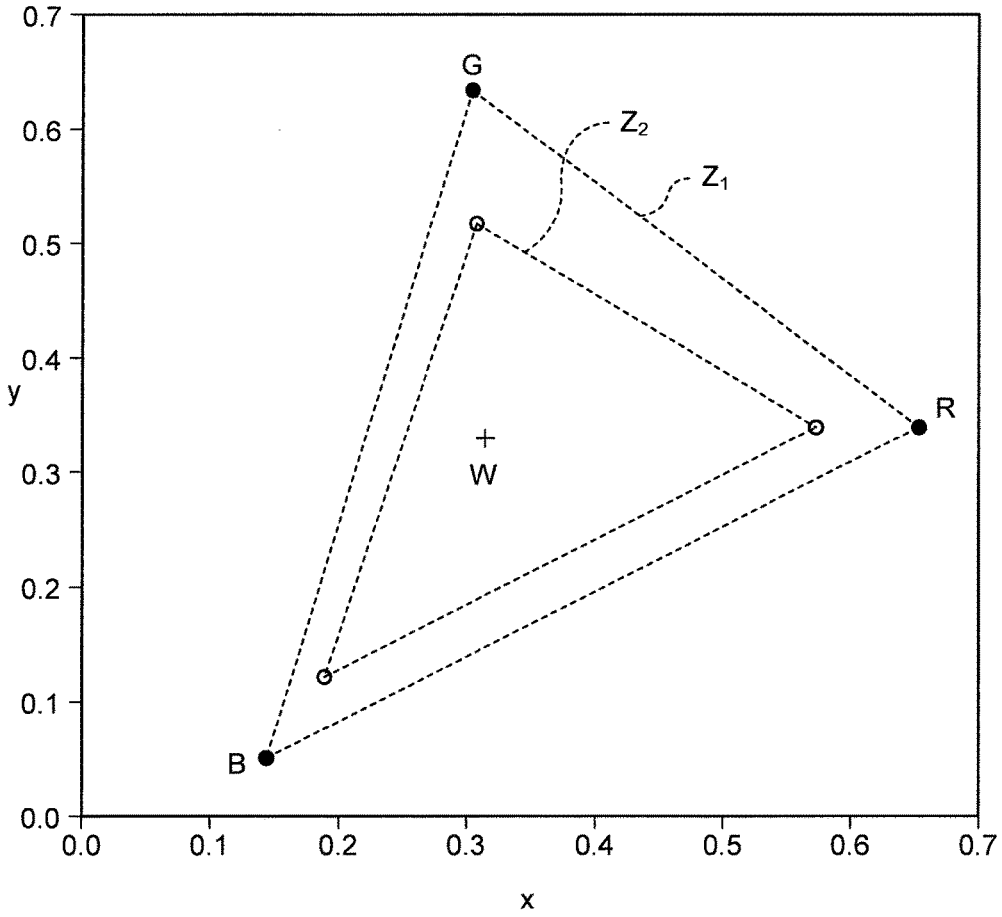
FIG. 7 is a diagram illustrating an example of a color space that can be extended (expanded) with the sub-pixels included in the first pixel and a color space that can be extended with the sub-pixels included in the second pixel.

FIG. 7 is a diagram illustrating an example of a color space $Z_1$ that can be extended with the sub-pixels 32 included in the first pixel 31A and a color space $Z_2$ that can be extended with the sub-pixels 32 included in the second pixel 31B. In the example illustrated in FIG. 7, white (W) is at a position corresponding to the center part (R, G, B)=(255, 255, 255) inside triangles representing the color space $Z_1$ and the color space $Z_2$. As illustrated in FIG. 7, in the embodiment, the transmittance of the sub-pixels 32 belonging to the second pixel 31B is designed to be higher than that of the sub-pixels 32 belonging to the first pixel 31A, so that an upper limit of the saturation that can be extended with the second pixel 31B is lower than the upper limit of the saturation that can be extended with the first pixel 31A. That is, the upper limit of the saturation of the color space (second color gamut) $Z_2$ of the sub-pixels 32 included in the second pixel 31B is within a range of the color space (first color gamut) $Z_1$ of the sub-pixels 32 included in the first pixel 31A. Accordingly, in the embodiment, the first pixel 31A can express any of the colors in the color spaces $Z_1$ and $Z_2$. The second pixel 31B having efficiency higher than that of the first pixel 31A cannot express the colors in a region outside the color space $Z_2$ and within the color space $Z_1$, and can express only the colors within the color space $Z_2$.

The color gamut of RGB and the like illustrated in FIG. 7 is indicated by a triangular range on an xy chromaticity range of the XYZ color system. However, a predetermined color space in which a defined color gamut is defined is not limited to be determined to be the triangular range, and may be determined to be a range of any shape such as a polygon corresponding to the number of colors of the sub-pixels.

Six types of color filters 61 arranged between the observer and each of the first sub-pixel 32R1, the second sub-pixel 32G1, the third sub-pixel 32B1, the fifth sub-pixel 32R2, the sixth sub-pixel 32G2, and the seventh sub-pixel 3282 can be collectively formed, for example, by causing the exposure of the color filter 61 arranged between the observer and each of the fifth sub-pixel 32R2, the sixth sub-pixel 32G2, and the seventh sub-pixel 32B2 to be larger than the exposure of the color filter 61 arranged between the observer and each of the first sub-pixel 32R1, the second sub-pixel 32G1, and the third sub-pixel 32B1. The six types of color filters 61 can be collectively formed by causing the area of the color filter 61 arranged between the observer and each of the fifth sub-pixel 32R2, the sixth sub-pixel 32G2, and the seventh sub-pixel 32B2 to be smaller than the area of the color filter 61 arranged between the observer and each of the first sub-pixel 32R1, the second sub-pixel 32G1, and the third sub-pixel 32B1. Additionally, the six types of color filters 61 can be collectively formed by forming the color filter 61 arranged between the observer and each of the fifth sub-pixel 32R2, the sixth sub-pixel 32G2, and the seventh sub-pixel 32B2 on a resist that is a transparent or white base layer. Due to this, a manufacturing step can be simplified as compared with a case of independently manufacturing the six types of color filters 61.

In the embodiment, in the signal processing unit 21, when the saturation of an input image signal is within the color space $Z_2$, the first pixel 31A and the second pixel 31B independently perform output (for example, light emission) corresponding to their respective input image signals. In the signal processing unit 21, when the saturation of the input image signal is outside the color space $Z_2$ and within the color space $Z_1$, each of the first pixel 31A and the second pixel 31B shares an output corresponding to the input image signal of the first pixel 31A with the second pixel 31B adjacent to the first pixel 31A to perform output (for example, light emission).

Arrangement of Pixels and Sub-Pixels

Figure 8:
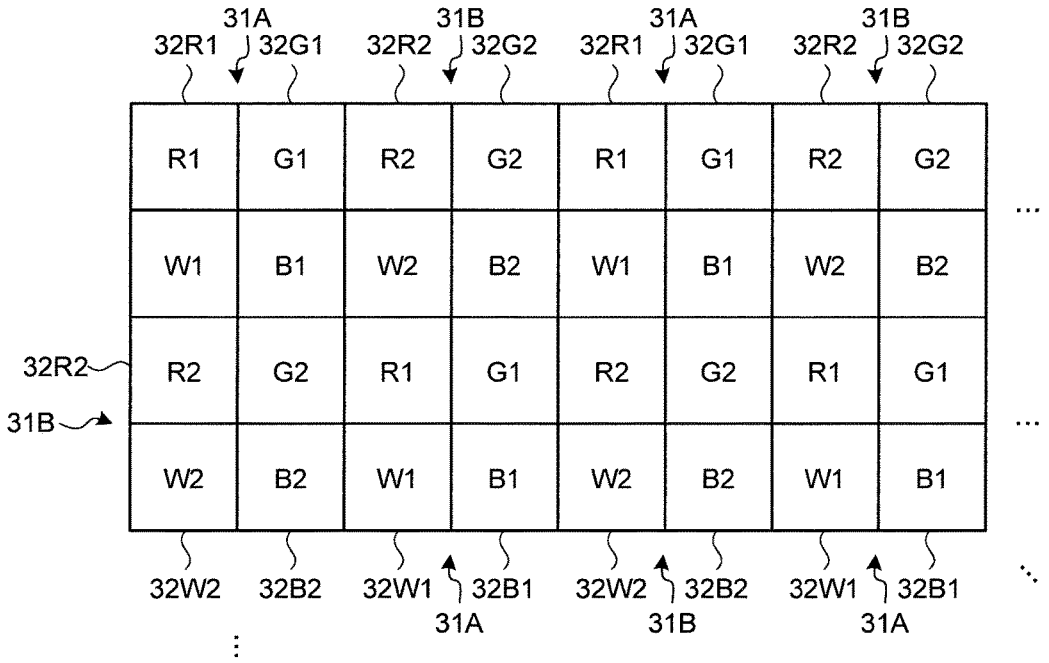
FIG. 8 is a diagram illustrating an example of a positional relation between the first pixel and the second pixel and an arrangement of the sub-pixels included in each of the first pixel and the second pixel.

Next, the following describes an arrangement example of the pixels 31 and the sub-pixels 32 with reference to FIG. 8 in detail. FIG. 8 is a diagram illustrating an example of a positional relation between the first pixel 31A and the second pixel 31B and an arrangement of the sub-pixels 32 included in each of the first pixel 31A and the second pixel 31B. As illustrated in FIG. 8, in the image display unit 30, the pixels 31 are arranged in a two-dimensional matrix. The first pixel 31A and the second pixel 31B are arranged to be adjacent to each other. The second pixels 31B are arranged in a staggered manner. Accordingly, the first pixels 31A adjacent to the second pixels 31B are also arranged in a staggered manner. The "staggered manner" herein means that, in a matrix arrangement in which partitions (outlines) between the pixels 31 draw a grid pattern in the display area, the pixels 31 are alternately arranged in the row direction and the column direction (or a vertical direction and a horizontal direction), which corresponds to what is called a checkered pattern (check pattern).

As described above, the image display device 100 includes the image display unit 30 in which the first pixel 31A including the sub-pixels 32 of three or more colors included in the first color gamut and the second pixel 31B including the sub-pixels 32 of three or more colors included in the second color gamut within the first color gamut are arranged in a matrix, the first pixel 31A being adjacent to the second pixel 31B. In the embodiment, "adjacent to" means that the first pixel 31A and the second pixel 31B are next to each other in a direction along at least one of the row direction (horizontal direction) and the column direction (vertical direction) of the image display unit 30, and does not include a case in which the pixels 31 are arranged in an oblique direction tilted with respect to the row direction and the column direction.

The arrangement of the sub-pixels 32 in the first pixel 31A and the arrangement of the sub-pixels 32 in the second pixel 31B may be made to have a certain correspondence relation. The sub-pixels 32 in the first pixel 31A and the sub-pixels 32 in the second pixel 31B may be arranged so that arrangements of hues in the respective pixels 31 approximate to each other when the hue of the sub-pixels 32 included in the first pixel 31A is compared with the hue of the sub-pixels 32 included in the second pixel 31B. Regarding the arrangement of the sub-pixels 32 in the first pixel 31A and the arrangement of the sub-pixels 32 in the second pixel 31B, any color arrangement may be employed so long as they are symmetrically rotated (symmetrically moved) combinations. Preferred is an array in which the sub-pixels 32 having the same hue are periodically and repeatedly arranged. In a case in which the sub-pixels 32 are arranged in two rows and two columns (2×2) in each of the first pixel 31A and the second pixel 31B, and the sub-pixels 32 in the first pixel 31A are the first sub-pixel 32R1, the second sub-pixel 32G1, the third sub-pixel 32B1, and the fourth sub-pixel 32W1 in the order of the upper left, the upper right, the lower right, and the lower left, the sub-pixels 32 in the second pixel 31B may be the fifth sub-pixel 32R2, the sixth sub-pixel 32G2, the seventh sub-pixel 32B2, and the eighth sub-pixel 32W2 in the order of the upper left, the upper right, the lower right, and the lower left. In this case, when the first pixel 31A and the second pixel 31B are assumed to be hue circles, rotation directions of the hues are the same.

The arrangement of the white sub-pixel in the first pixel 31A is the same as the arrangement of the white sub-pixel in the second pixel 31B. For example, the fourth sub-pixel 32W1 and the eighth sub-pixel 32W2 are both arranged at the lower left of the pixel 31. The white sub-pixel is not necessarily arranged at the lower left, and may be arranged at any position in the pixel 31.

As illustrated in FIG. 8, in principle, the following describes a case in which the second pixels 31B are arranged in a staggered manner, and a relation between the arrangement of the sub-pixels 32 included in the first pixel 31A and the arrangement of the sub-pixels 32 included in the second pixel 31B corresponds to the color component. However, the present invention is not limited thereto. The arrangement of the sub-pixels 32 included in the first pixel 31A and the arrangement of the sub-pixels 32 included in the second pixel 31B can be appropriately changed within a range in which the effect of the present invention can be obtained.

The output signal is individually output to the first pixel 31A and the second pixel 31B according to the arrangement of the first pixel 31A and the second pixel 31B. The output signal indicating a light emitting state of each of the first sub-pixel 32R1, the second sub-pixel 32G1, the third sub-pixel 32B1, and the fourth sub-pixel 32W1 that emit light of red (R), green (G), blue (B), and white (W) is output to a position corresponding to the first pixel 31A. The output signal indicating the light emitting state of each of the fifth sub-pixel 32R2, the sixth sub-pixel 32G2, the seventh sub-pixel 3282, and the eighth sub-pixel 32W2 that emit light of red (R), green (G), blue (B), and white (W) is output to a position corresponding to the second pixel 31B.

Figure 9:
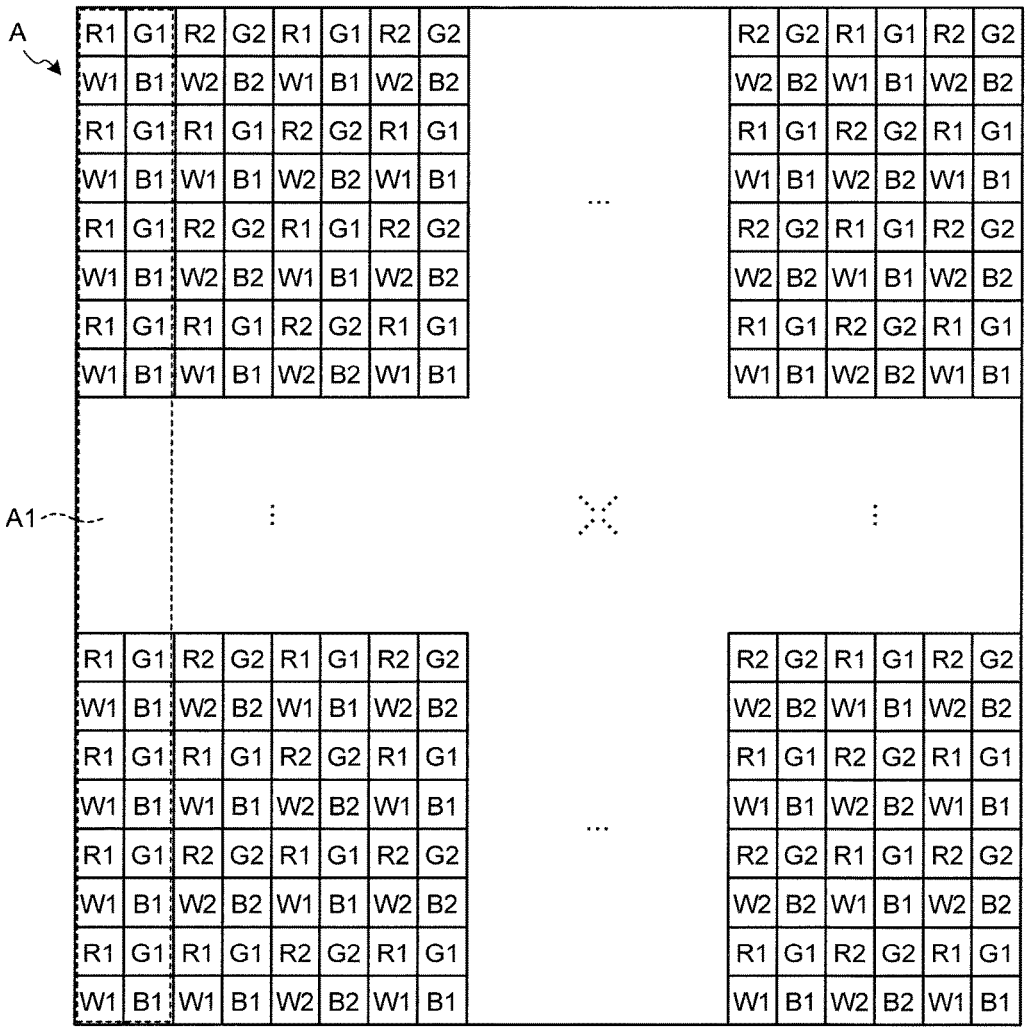
FIG. 9 is a diagram illustrating an example of a display area in which pixels adjacent to one side are first pixels.

In the embodiment, the pixels adjacent to at least one side of the display area A may be the first pixels 31A. FIG. 9 is a diagram illustrating an example of the display area A in which the pixels adjacent to one side are the first pixels 31A. As illustrated in FIG. 9, in an adjacent-to-side region A1, all the pixels constituting a pixel column adjacent to one side corresponding to an outer edge of the display area A may be the first pixels 31A. Each of the first pixels 31A independently performs output (for example, light emission) corresponding to each input image signal.

Figure 10:
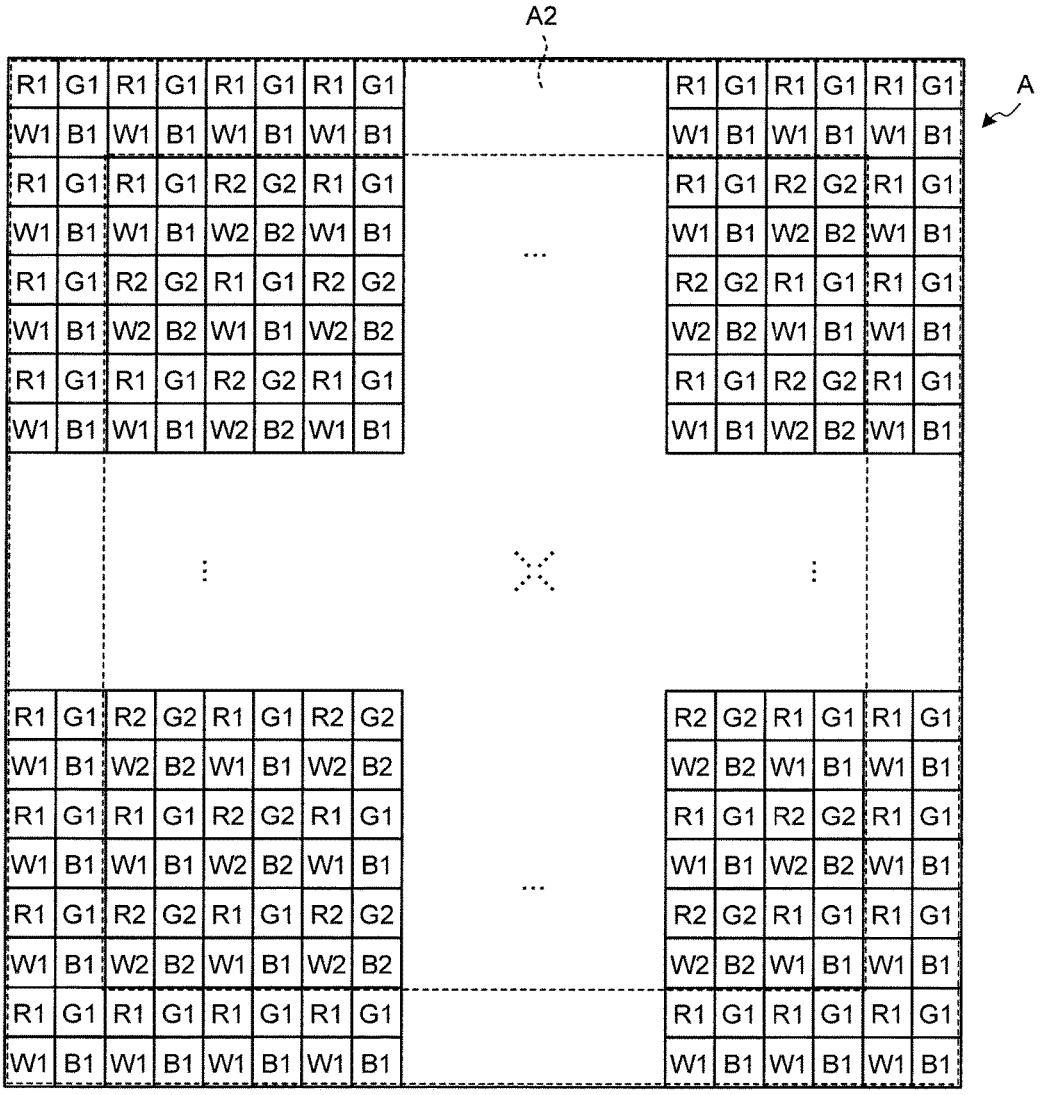
FIG. 10 is a diagram illustrating an example of a display area in which pixels adjacent to four sides are the first pixels.

The pixels adjacent to two or more sides of the display area A may be the first pixels 31A. FIG. 10 is a diagram illustrating an example of the display area A in which the pixels adjacent to four sides are the first pixels 31A. As represented as an adjacent-to-side region A2 in FIG. 10, the pixels adjacent to all the sides of the rectangular display area A may be the first pixels 31A. In this case, in the image display device 100 or an electronic apparatus including a detection unit such as an acceleration sensor and a rotation control unit that controls a rotation state of a screen according to a detection result of the detection unit, the second pixel 31B that is adjacent to the adjacent-to-side region A2 can always be adjacent to the first pixel 31A. In this case, the detection unit detects an inclination of the image display device 100 by measuring gravity acceleration with respect to large gravity of the earth and the like, for example. The rotation control unit determines the top, the bottom, the left, and the right of the display area A according to the detection result of the detection unit, and causes the signal processing unit 21 or the drive circuit 40 to perform output corresponding to the determined top, bottom, left, and right. In FIG. 10, the pixels adjacent to the four sides are the first pixels 31A. Alternatively, only the pixels adjacent to two sides or three sides thereamong may be the first pixels 31A. When the image display device 100 has a polygonal shape other than a quadrangle, the pixels adjacent to part or all of the sides thereof may be the first pixels 31A.

Processing of Image Processing Circuit

Next, the following describes processing performed by the image processing circuit 20. When the hue, the saturation, and the luminance of the color indicated by the second component that is the component of the input image signal corresponding to the second pixel 31B are components within the second color gamut, the signal processing unit 21 determines an output of the sub-pixels 32 included in the first pixel 31A based on the first component that is the component of the input image signal corresponding to the first pixel 31A, and determines the output of the sub-pixels 32 included in the second pixel 31B based on the second component that is the component of the input image signal corresponding to the second pixel 31B. The signal processing unit 21 performs color conversion on the first component that is the component of the input image signal corresponding to the first pixel 31A and the second component that is the component of the input image signal corresponding to the second pixel 31B between the first pixel 31A and the second pixel 31B adjacent to each other, and determines the output of the sub-pixels 32 included in the first pixel 31A and the output of the sub-pixels 32 included in the second pixel 31B. When the second component that is the component of the input image signal corresponding to the second pixel 31B includes an out-of-color gamut component outside the second color gamut, the signal processing unit 21 performs color conversion on the first component that is the component of the input image signal corresponding to the first pixel 31A and the second component that is the component of the input image signal corresponding to the second pixel 31B between the first pixel 31A and the second pixel 31B adjacent to each other, and determines the output of the sub-pixels included in the second pixel 31B. The "output of the sub-pixels 32" includes intensity of light when there is an output of light regardless of whether there is an output of light from the sub-pixels 32 or not. That is, "determine the output of the sub-pixels 32" means to determine the light intensity from each sub-pixel 32. Additionally, "cause the component to be reflected in the output of the sub-pixels 32" means to reflect an increase or a decrease in the light intensity corresponding to the component in the intensity of light in the output of light from the sub-pixels 32.

In the embodiment, the input image signal corresponds to the RGB color space. The following describes a case in which each gradation of the red (R) component, the green (G) component of the input image signal, and the blue (B) component is expressed by 8 bits (256 gradations), that is, a case in which the input image signal is configured in a range of (R, G, B)=(0, 0, 0) to (255, 255, 255). As described above, in the embodiment, the components of the input image signal correspond to three colors of sub-pixels 32 included in the first pixel 31A. Such an input image signal is merely an example of the components of the input image signal, and is not limited thereto. The input image signal can be appropriately modified. Specific numerical values of the input image signal described below are merely an example, and not limited thereto. Alternatively, any numerical value can be used.

Figure 11:
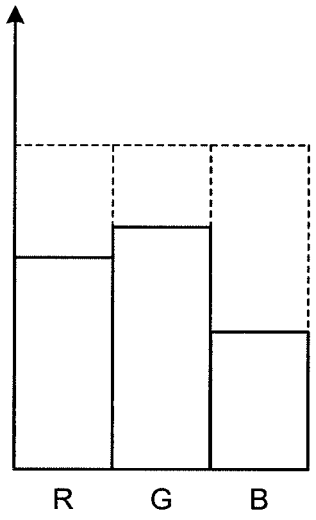
FIG. 11 is a diagram illustrating an example of components of an input image signal.

FIG. 11 is a diagram illustrating an example of the components of the input image signal. In the following description, described is a case in which both of the input image signal corresponding to the first pixel 31A and the input image signal corresponding to the second pixel 31B are input image signals indicating the components of red (R), green (G), and blue (B) as illustrated in FIG. 11. That is, in this case, each of the first component that is the component of the input image signal corresponding to the first pixel 31A and the second component that is the component of the input image signal corresponding to the second pixel 31B is a combination of color values of red (R), green (G), and blue (B) illustrated in FIG. 9, and is a component (R, G, B) constituting a color represented by the combination.

Processing Performed by Signal Processing Unit: Basic Processing

Figure 12:
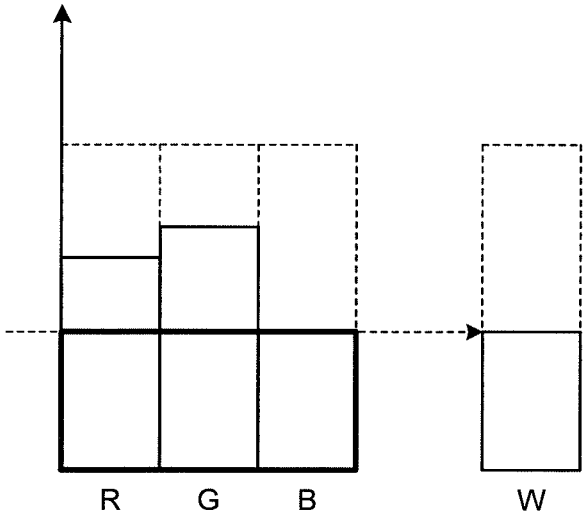
FIG. 12 is a diagram illustrating an example of processing for converting components of red (R), green (G), and blue (B) into a component of white (W)

First, the following describes processing related to determination of the output of the sub-pixels 32 included in the pixel 31. FIG. 12 is a diagram illustrating an example of processing for converting the components of red (R), green (G), and blue (B) into a component of white (W). As illustrated in FIG. 12, the signal processing unit 21 extracts, from the components of red (R), green (G), and blue (B), an amount of components corresponding to an amount of components the saturation of which is the smallest (in a case of FIG. 10, blue (B)) among the components of red (R), green (G), and blue (B) that are the components of the input image signal corresponding to the pixel 31, and converts the extracted amount of the components into white (W). White (W) is a color of the fourth sub-pixel 32W1 and the eighth sub-pixel 32W2. In this way, the signal processing unit 21 performs processing for converting, into white, the components that can be extended with white among the components of the input image signal corresponding to the pixel 31.

Figure 13:
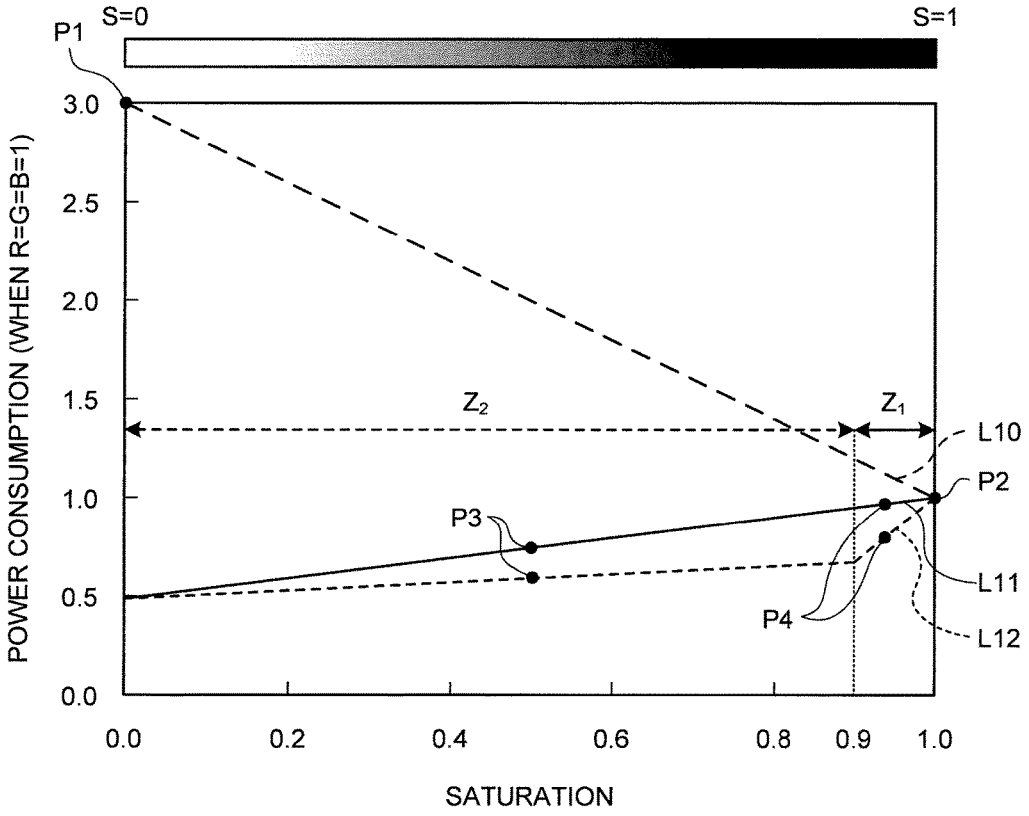
FIG. 13 is a graph illustrating a relation between saturation of an input image and power consumption.

FIG. 13 is a graph illustrating a relation between the saturation of the input image and power consumption. FIGS. 14 to 17 are diagrams illustrating a relation between lighting quantity and each of the first pixel 31A and the second pixel 31B at each point of the saturation illustrated in FIG. 13. In FIG. 13, the horizontal axis indicates the saturation of the input image, the vertical axis indicates the power consumption, a dotted line L10 indicates the power consumption in a case of using an RGB system, a straight line L11 indicates the power consumption in a case of displaying an image using only the first pixel 31A (hereinafter, also referred to as an "RGBW1 system"), and a dotted line L12 indicates the power consumption in a case of displaying an image using the first pixel 31A and the second pixel 31B (hereinafter, also referred to as an "RGBW2 system"). In the example illustrated in FIG. 13, a range in which the saturation of the input image is 0.9 to 1.0 corresponds to a range of a color space $Z_1$, and a range in which the saturation of the input image is in a range that is more than and equal to 0.0, and less than 0.9, corresponds to a range of a color space $Z_2$. FIGS. 14 to 17 schematically illustrate an output image signal (data) of each sub-pixel 32 of the RGBW1 system, and an output image signal (data) of each sub-pixel 32 of the RGBW2 system.

Figure 14:
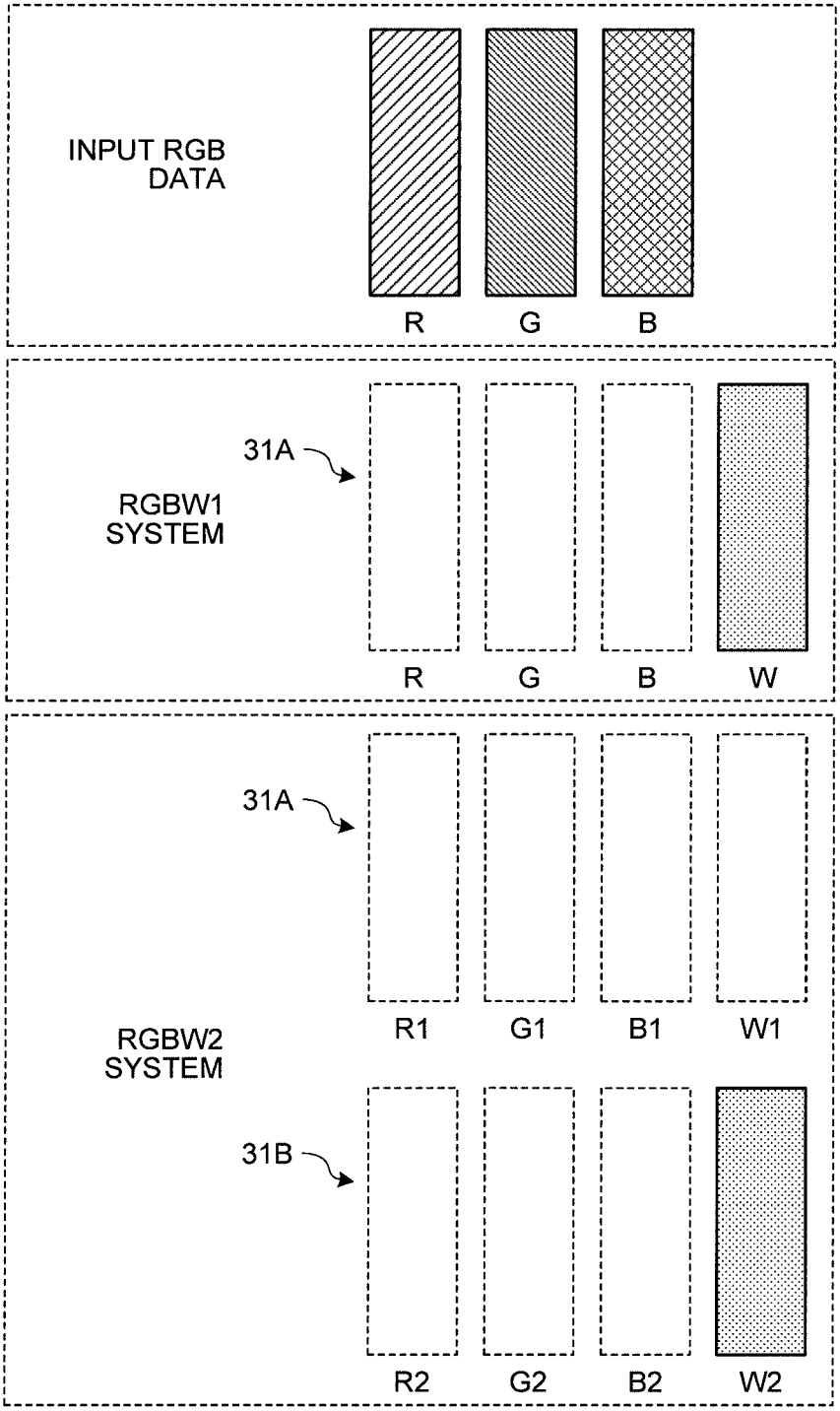
FIG. 14 is a diagram illustrating a relation between an output image signal (data) and each of the first pixel and the second pixel at a point of saturation illustrated in FIG. 13.

As illustrated in FIG. 14, when the input image signal (red (R), green (G), and blue (B))=(255, 255, 255) (refer to the point P1 in FIG. 13) with saturation S=0 within the range of the color space $Z_2$ is input, the signal processing unit 21 converts all of the components of red (R), green (G), and blue (B) into the component of white (W). In this case, the signal processing unit 21 sets (red (R), green (G), blue (B), white (W))=(0, 0, 0, 255) in the RGBW1 system, and sets (red (R1), green (G1), blue (B1), white (W1), red (R2), green (G2), blue (B2), white (W2))=(0, 0, 0, 0, 0, 0, 0, 255) in the RGBW2 system. The fourth sub-pixel 32W1 and the eighth sub-pixel 32W2 have the same transmittance, so that the power consumption in lighting of the fourth sub-pixel 32W1 is the same as that in lighting of the eighth sub-pixel 32W2. In this case, light emission quantity (light emission efficiency) of the fourth sub-pixel 32W1 and the eighth sub-pixel 32W2 is two times, as output luminance, that in a case in which all of the first sub-pixel 32R1, the second sub-pixel 32G1, and the third sub-pixel 32B1 are lit, so that the power consumption can be reduced from the power consumption 3.0 to the power consumption 0.5.

Figure 15:
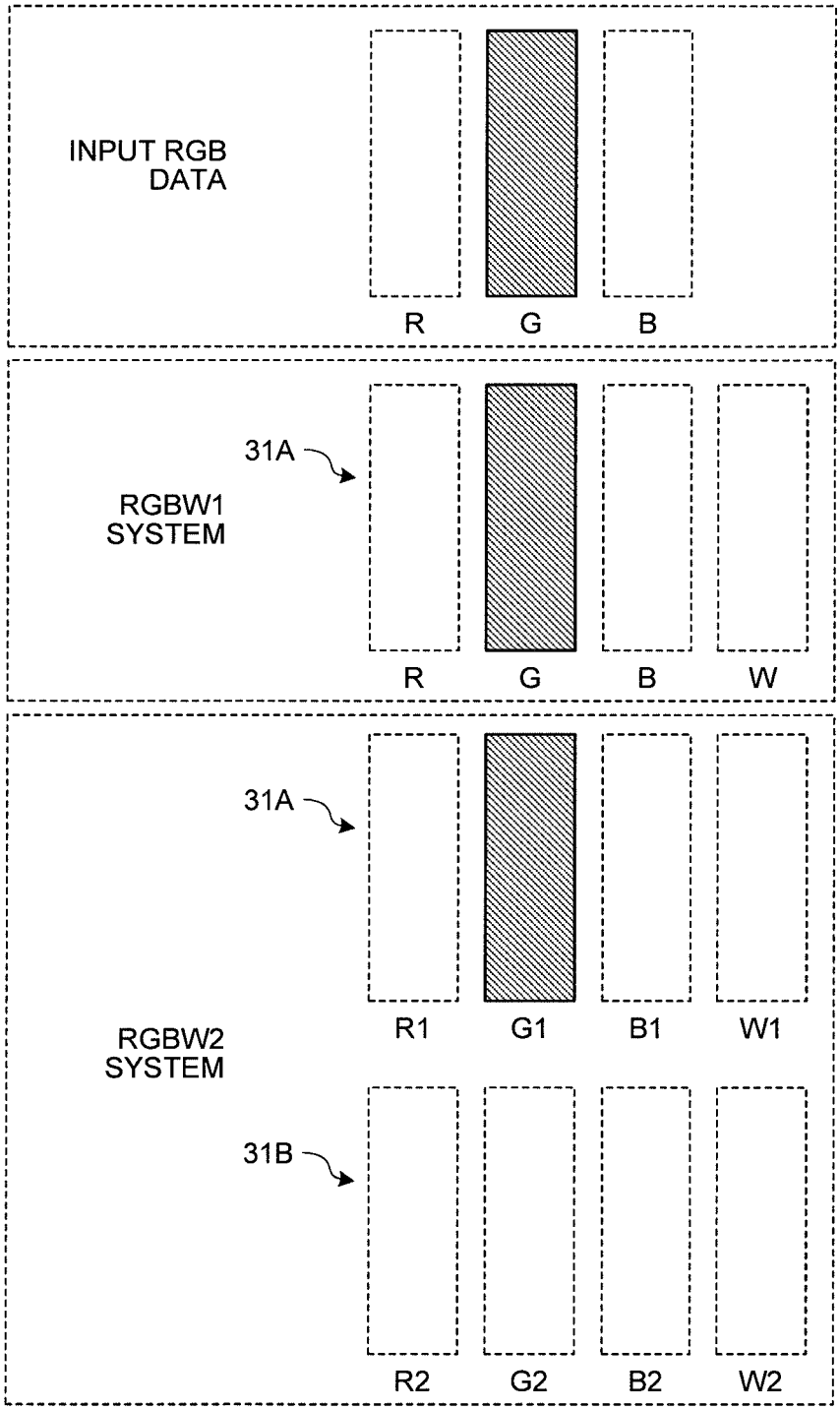
FIG. 15 is a diagram illustrating a relation between the output image signal (data) and each of the first pixel and the second pixel at a point of saturation illustrated in FIG. 13.

As illustrated in FIG. 15, when the input image signal ((red (R), green (G), blue (B))=(0, 255, 0), refer to the point P2 in FIG. 13)) with saturation S=1 within the range of the color space $Z_1$ that is outside the range of the color space $Z_2$ is input, the signal processing unit 21 sets (red (R), green (G), blue (B), white (W))=(0, 255, 0, 0) in the RGBW1 system. On the other hand, the signal processing unit 21 sets (red (R1), green (G1), blue (B1), white (W1), red (R2), green (G2), blue (B2), white (W2))=(0, 255, 0, 0, 0, 0, 0, 0) also in the RGBW2 system because an image with saturation S=1 cannot be displayed by the sixth sub-pixel 32G2 of the second pixel 31B having the transmittance higher than that of the second sub-pixel 32G1. As a result, the power consumption in a case of using only the first pixel 31A is the same as the power consumption in a case of using both of the first pixel 31A and the second pixel 31B.

Figure 16:
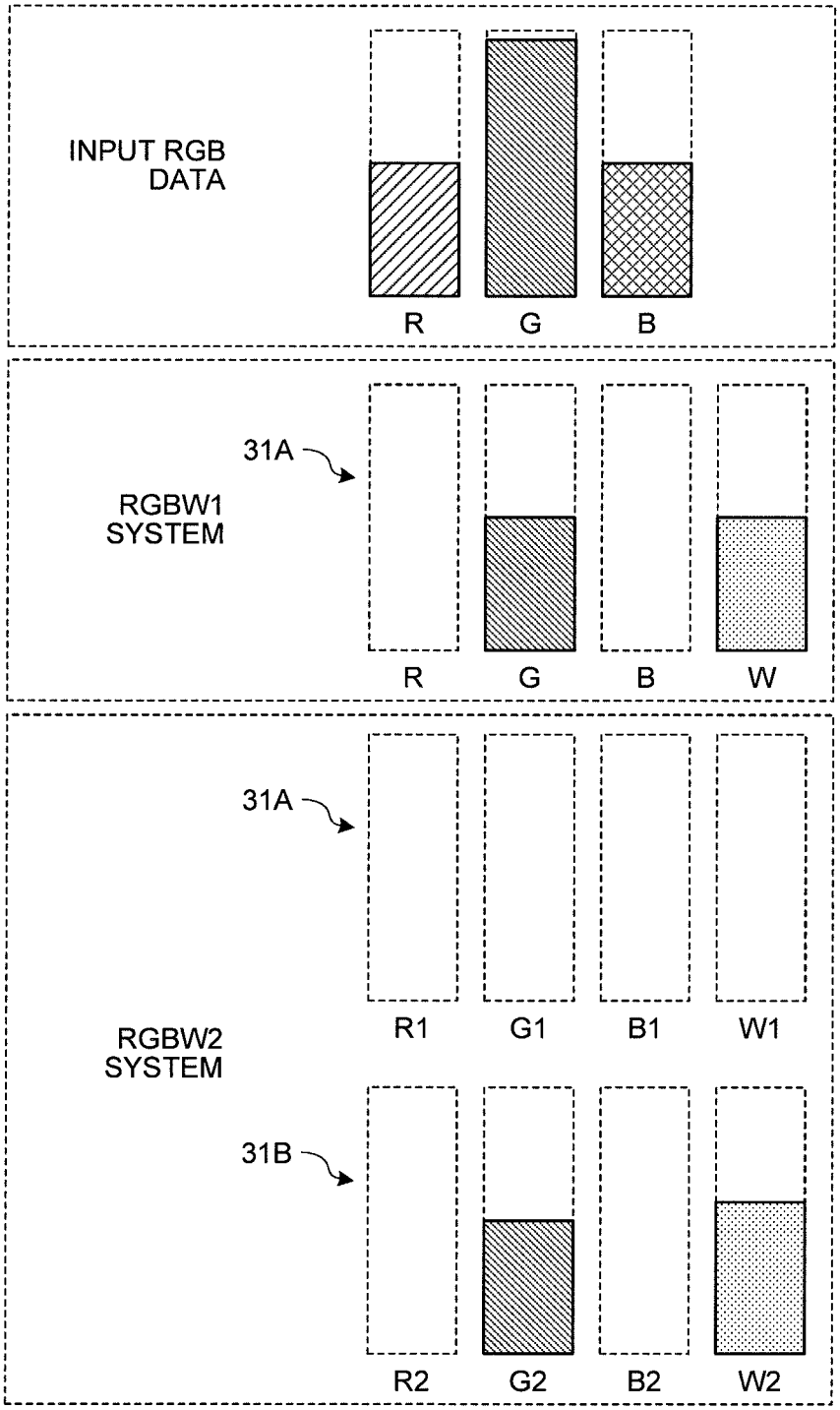
FIG. 16 is a diagram illustrating a relation between the output image signal (data) and each of the first pixel and the second pixel at a point of saturation illustrated in FIG. 13.

As illustrated in FIG. 16, when the input image signal ((red (R), green (G), blue (B))=(128, 255, 128), refer to the point P3 in FIG. 13) with saturation S=0.5 within the range of the color space $Z_2$ is input, the signal processing unit 21 sets (red (R), green (G), blue (B), white (W))=(0, 128, 0, 128) in the RGBW1 system. On the other hand, the signal processing unit 21 sets (red (R1), green (G1), blue (B1), white (W1), red (R2), green (G2), blue (B2), white (W2))=(0, 0, 0, 0, 0, 115, 0, 128) in the RGBW2 system. Accordingly, in a case of using both of the first pixel 31A and the second pixel 31B, color information of the input image signal can be output with the sub-pixel 32 having the transmittance higher than that in a case of using only the first pixel 31A, so that the power consumption can be further reduced.

Figure 17:
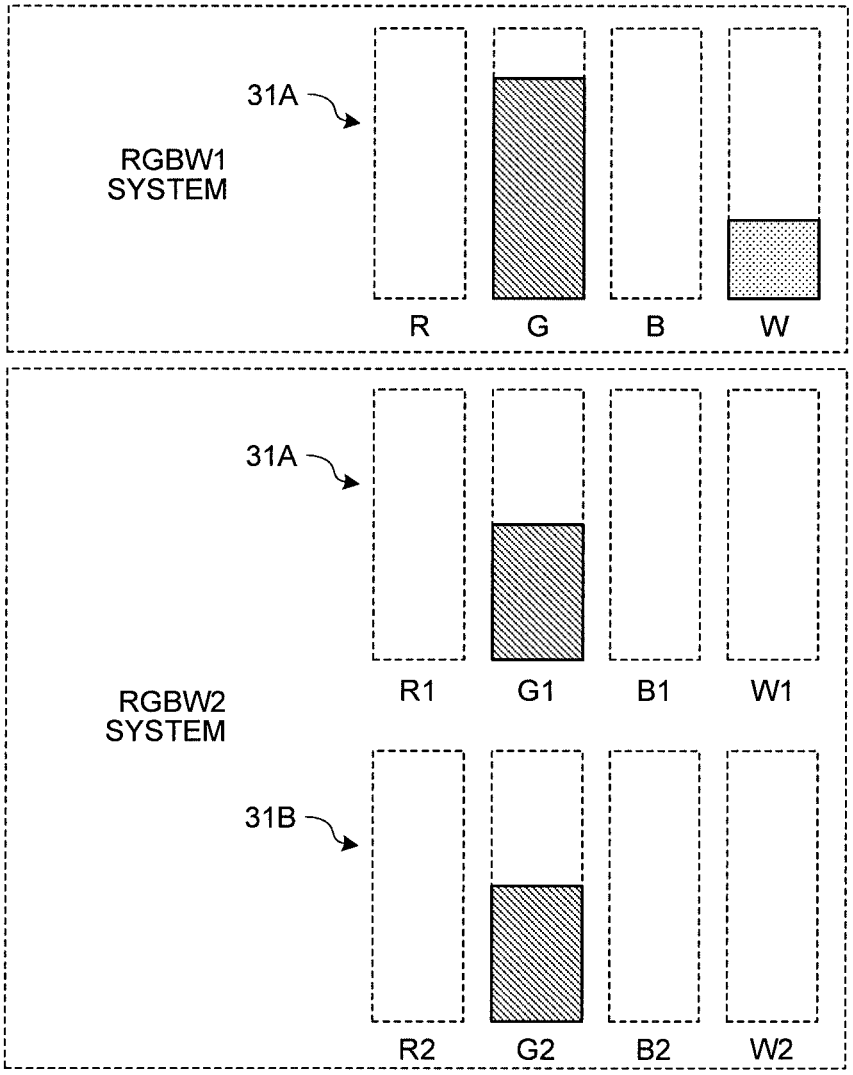
FIG. 17 is a diagram illustrating a relation between the output image signal (data) and each of the first pixel and the second pixel at a point of saturation illustrated in FIG. 13.

As illustrated in FIG. 17, when the input image signal (refer to the point P4 in FIG. 13) with saturation S=substantially 0.95 within the range of the color space $Z_2$ is input, the signal processing unit 21 adjusts the lighting quantity of the fourth sub-pixel 32W1 and the second sub-pixel 32G1 to express the image with saturation S=0.95 in the RGBW1 system. On the other hand, in the RGBW2 system, the signal processing unit 21 causes the lighting quantity of the second sub-pixel 32G1 and the sixth sub-pixel 32G2 having the luminance higher than that of the second sub-pixel 32G1 to be in a predetermined range, and expresses the image with saturation S=0.95. Accordingly, in the case of using both of the first pixel 31A and the second pixel 31B, the color information of the input image signal can be output with the sub-pixel 32 having higher transmittance or the sub-pixel 32 including the color filter 61 having higher transmittance as compared with the case of using only the first pixel 31A, so that the power consumption can be further reduced.

Figure 18:
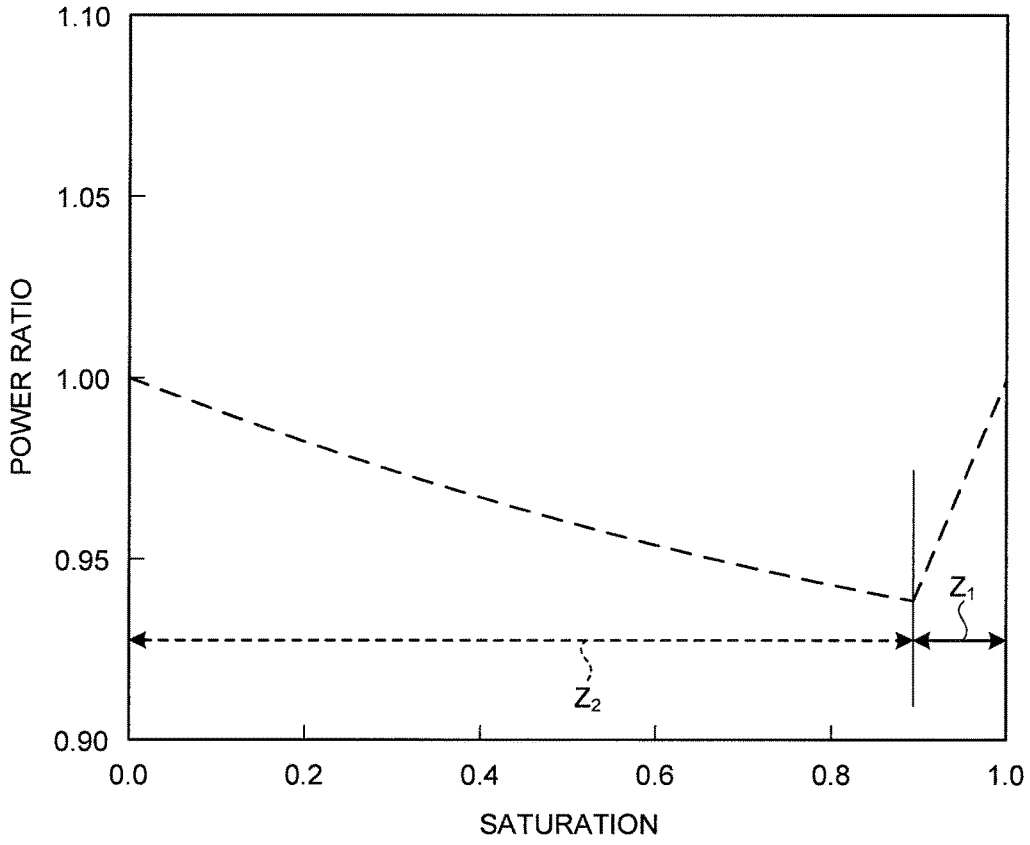
FIG. 18 is a graph illustrating a relation between power consumption of the image display device and the saturation of the input image.

FIG. 18 is a graph illustrating a relation between the power consumption of the image display device 100 and the saturation of the input image. In FIG. 18, the horizontal axis indicates the saturation of the input image, and the vertical axis indicates a power ratio where the power consumption in displaying the image with saturation S=0 is 1.

As illustrated in FIG. 18, when the saturation of the input image is low with saturation S=0 or high with saturation S=1, as described above, the sub-pixel 32 to be lit and the lighting quantity of the sub-pixel 32 in the RGBW2 system are the same as those in the RGBW1 system, which causes the power ratio to be 1.00. On the other hand, the power ratio decreases as the saturation S of the input image approaches an outer edge of the color space $Z_2$, and becomes the minimum in a region between the color space $Z_1$ and the color space $Z_2$ that is the maximum range that can be extended with the second pixel 31B. In this way, according to the embodiment, the second pixel 31B having higher transmittance and lower saturation than those of the first pixel 31A is used together with the first pixel 31A, so that electric power can be efficiently reduced in a range from low saturation to middle saturation in which, specifically, a natural image of the input image and the like are included.

Figure 19:
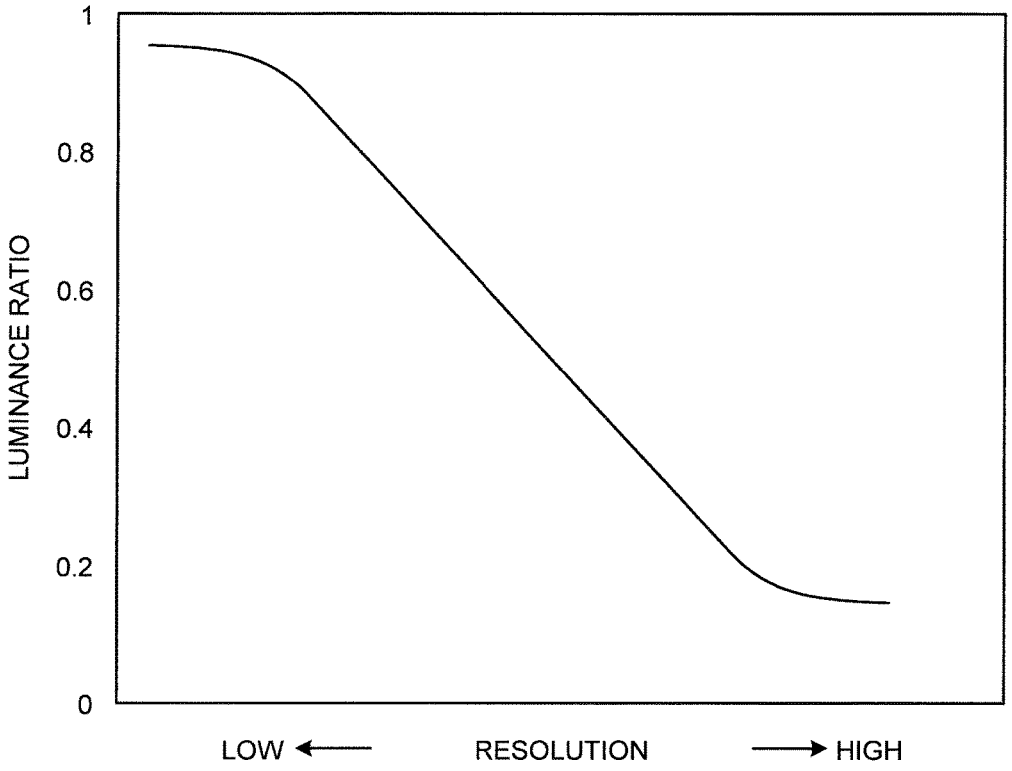
FIG. 19 is a graph illustrating a relation between resolution of the input image and a luminance ratio between the sub-pixel of the first pixel and the sub-pixel of the second pixel.

Next, the following describes color conversion in the image display device 100 according to the embodiment in detail. FIG. 19 is a graph illustrating a relation between resolution of the input image and a luminance ratio between the sub-pixel 32 of the first pixel 31A and that of the second pixel 31B. In FIG. 19, the horizontal axis indicates the resolution of the input image, and the vertical axis indicates the luminance ratio between the sub-pixel 32 of the first pixel 31A and that of the second pixel 31B (the sub-pixel 32 of the first pixel 31A/the sub-pixel 32 of the second pixel 31B).

In the embodiment, when the input image signal with respect to the second pixel 31B is outside the range of the color space $Z_2$, color conversion is performed to display part of the input image signal with respect to the sub-pixel 32 of the first pixel 31A using the sub-pixel 32 of the second pixel 31B. In this case, as illustrated in FIG. 19, when the resolution of the input image is low, the luminance of the second pixel 31B is reduced and the luminance of the first pixel 31A is increased. Accordingly, the image can be displayed only with the first pixel 31A, so that the power consumption can be reduced. When the resolution of the input image is high, the luminance of the second pixel 31B is increased and the luminance of the first pixel 31A is reduced. Accordingly, the image can be displayed using the second pixel 31B having high luminance without reducing the resolution, so that the power consumption can be reduced.

Figure 20:
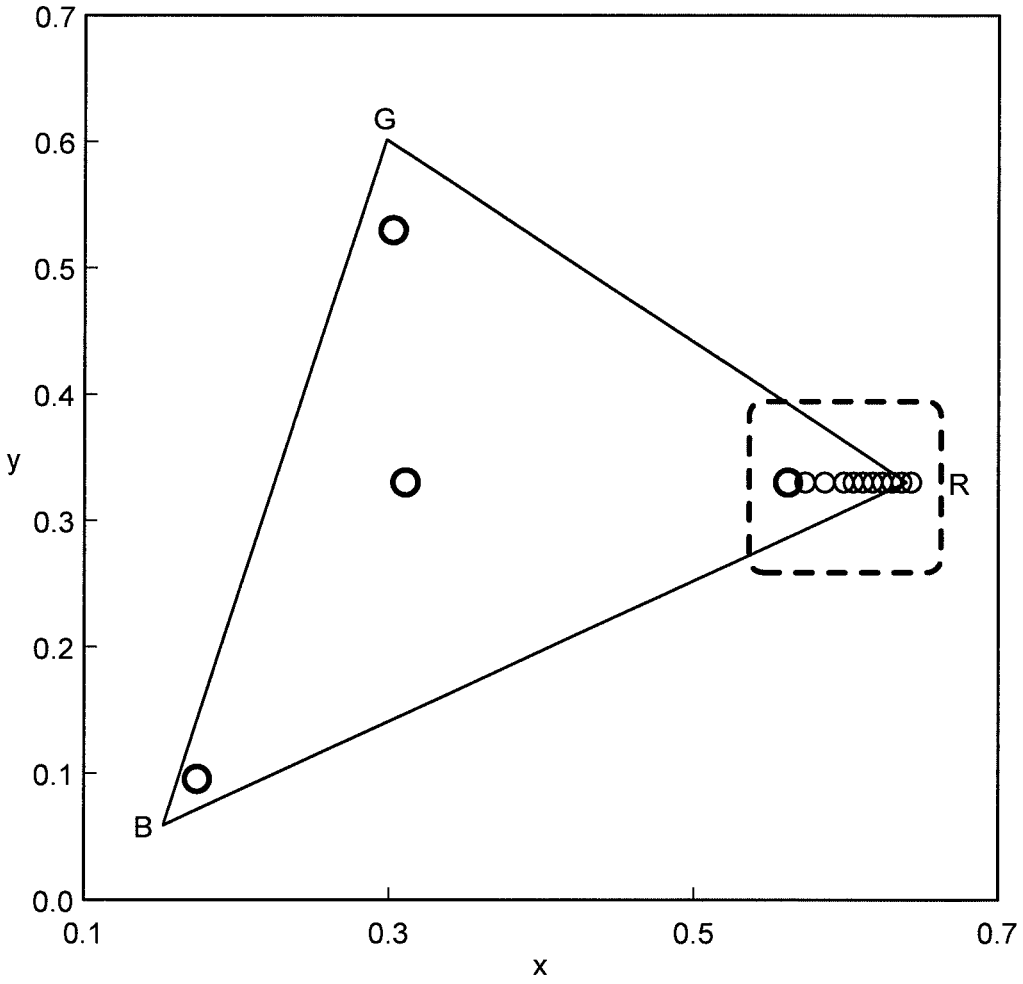
FIG. 20 is an explanatory diagram of the luminance ratio between the sub-pixel of the first pixel and the sub-pixel of the second pixel.
Figure 21:
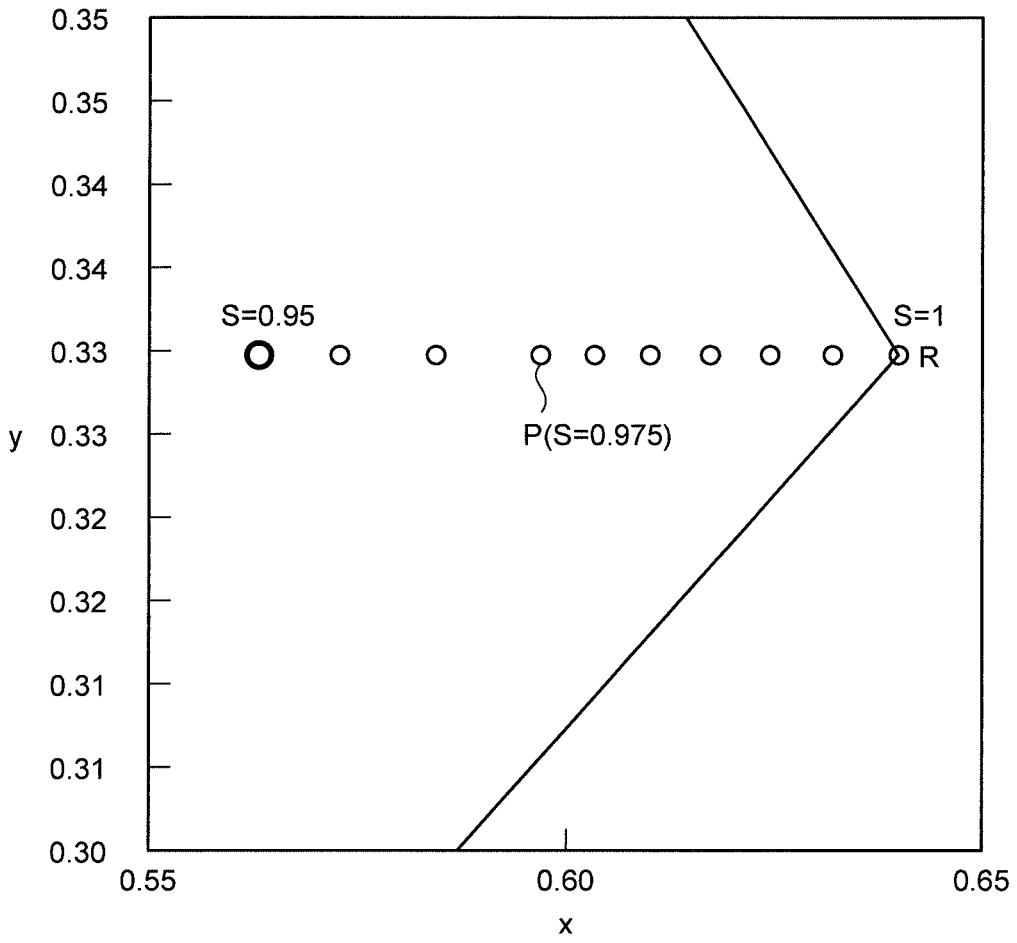
FIG. 21 is an explanatory diagram of the luminance ratio between the sub-pixel of the first pixel and the sub-pixel of the second pixel.
Figure 22:
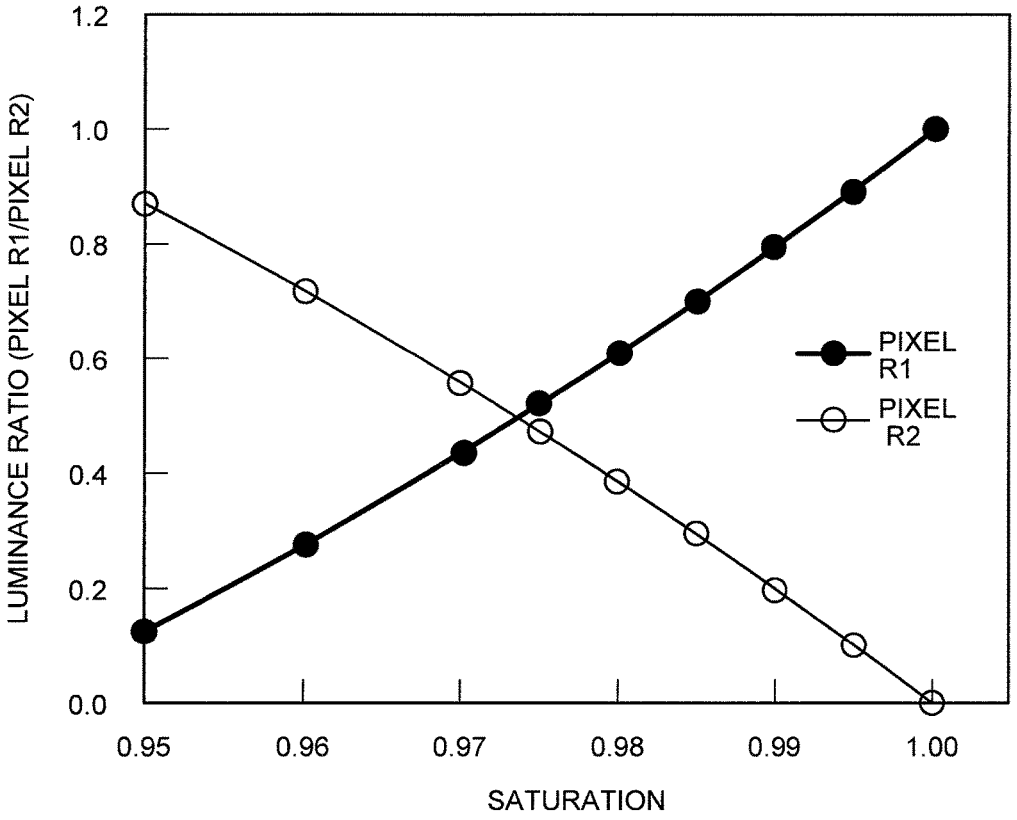
FIG. 22 is an explanatory diagram of the luminance ratio between the sub-pixel of the first pixel and the sub-pixel of the second pixel.

Next, the following describes the luminance ratio between the sub-pixel 32 of the first pixel 31A and that of the second pixel 31B in detail with reference to FIGS. 20 to 22. In the embodiment, color conversion is performed on image signals input to the first pixel 31A and the second pixel 31B according to color coordinates of the input image, the luminance ratio between the sub-pixels 32 of the first pixel 31A and that of the second pixel 31B is determined, and an optimum design value is set. In the example illustrated in FIGS. 20 to 22, the optimum design value is set in the vicinity of the saturation S=0.975 (refer to the point P in FIG. 21), and the luminance ratio between the first sub-pixel 32R1 of the first pixel 31A and the fifth sub-pixel 32R2 of the second pixel 31B is set to be 0.5 with the optimum design value. For example, as illustrated in FIGS. 21 and 22, when the saturation S=0.95, the luminance of the fifth sub-pixel 32R2 of the second pixel 31B is designed to be substantially 0.9, and the luminance of the first sub-pixel 32R1 of the first pixel 31A is designed to be substantially 0.1. The luminance ratio of the first sub-pixel 32R1 of the first pixel 31A is caused to be gradually increased from the saturation S=0.95 to the saturation S=1.00, and it is designed such that the luminance of the first sub-pixel 32R1 of the first pixel 31A is substantially the same as the luminance of the fifth sub-pixel 32R2 of the second pixel 31B in the vicinity of the saturation S=0.975 that is the optimum design value. Accordingly, the power consumption can be reduced without reducing the resolution of the input image.

Next, the following describes color conversion in the signal processing unit 21 in detail. The embodiment reduces the power consumption while improving the resolution and reliability of the input image by performing color conversion and lighting the sub-pixel 32 of the second pixel 31B in the color space $Z_1$ outside the range of the color space $Z_2$. This color conversion may be performed only in the color space $Z_2$, or may be performed in both of the color space $Z_1$ and the color space $Z_2$. In this case, a color conversion amount can be appropriately modified according to the hue and the saturation of the input image signal to perform processing according to human senses. When image conversion is performed to display the image using the first pixel 31A and the second pixel 31B, processing is performed such that the hue and the luminance of the output signal are as less changed as possible with respect to the input image signal. In color conversion, for example, the amount of color conversion into the second pixel 31B may be increased as the saturation is increased outside the range of the color space $Z_2$. In color conversion, the lighting quantity of the fourth sub-pixel 32W1 and the eighth sub-pixel 32W2 may be adjusted so as to maintain the luminance of the input image signal and so as not to change the hue. According to an application of the image display device 100 such as a power priority mode and a color priority mode, a color conversion ratio may be changed, and the color conversion amount may be changed between the first pixel 31A and the second pixel 31B.

The signal processing unit 21 performs color conversion to express, with the first pixel 31A, the out-of-color gamut component that is a component the color of which cannot be expressed with the sub-pixels 32 included in the second pixel 31B in the input image signals corresponding to the first pixel 31A and the second pixel 31B adjacent to each other, and processes the input image signals for the first pixel 31A and the second pixel 31B. Accordingly, even when there is a component the color of which cannot be expressed with the sub-pixels 32 included in the second pixel 31B, color expression corresponding to the input image signal can be performed. The outputs of the first pixel 31A and the second pixel 31B are determined so that at least one of the white sub-pixels is lit when there is a component that can be converted into white in the components of the input image signal, and the luminance of each pixel 31 thus can be secured by lighting the at least one of the white sub-pixels. That is, in terms of securing the luminance, the output of the sub-pixels 32 of the other colors can be further suppressed, so that a power-saving property at a higher level can be achieved. According to the hue and the saturation of the input image signal, the signal processing unit 21 may change a method for determining the output of the sub-pixels 32 in each pixel according to the input image signal. According to an average luminance of the input image, the signal processing unit 21 may adjust the color conversion amount so that, for example, the amount of color conversion from a high-luminance image is larger than that of the color conversion from a low-luminance image. When the luminance is expanded and the electric power is limited, the signal processing unit 21 may reduce a sense of resolution and increase the amount of color conversion into the second pixel 31B.

Figure 23A:
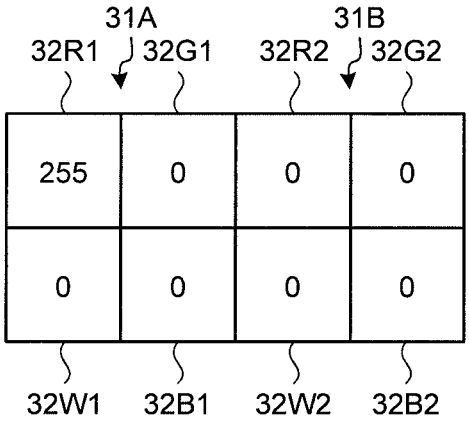
FIG. 23A is an explanatory diagram of color conversion in the image display device according to the embodiment.
Figure 23B:
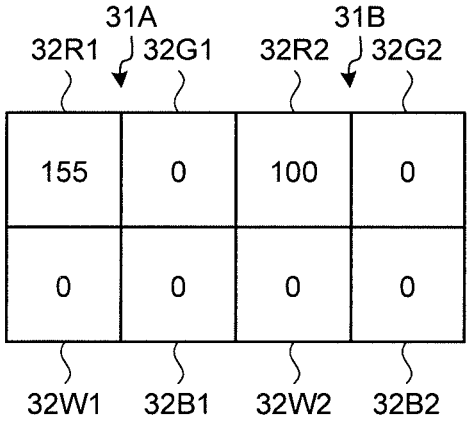
FIG. 23B is an explanatory diagram of color conversion in the image display device according to the embodiment.

Processing Performed by Signal Processing Unit: Specific Example of Color Conversion Next, the following describes a specific example of color conversion with reference to FIGS. 23A to 26C. FIGS. 23A to 26C are explanatory diagrams of color conversion in the image display device 100 according to the embodiment. First, as illustrated in FIG. 23A, the following describes a case in which the input image signal corresponding to the first pixel 31A is represented as (R, G, B)=(255, 0, 0), and the input image signal corresponding to the second pixel 31B adjacent to the first pixel 31A is represented as (R, G, B)=(0, 0, 0). In this case, the signal processing unit 21 converts, into the color of the fifth sub-pixel 32R2 included in the second pixel 31B, the component that can be expressed with the color of the fifth sub-pixel 32R2 included in the second pixel 31B among the components of the input image signal with respect to the first pixel 31A. As a result, as illustrated in FIG. 23B, the component of the first pixel 31A is represented as (R, G, B)=(155, 0, 0), and the component of the second pixel 31B is represented as (R, G, B)=(100, 0, 0). Accordingly, the input image signal can be output by lighting the fifth sub-pixel 32R2 the power consumption of which is smaller than that of the first sub-pixel 32R1 while the lighting quantity of the first sub-pixel 32R1 is reduced, so that the power consumption of the image display device 100 can be reduced. The input image can be expressed using the first pixel 31A and the second pixel 31B, which can maintain the resolution of the image.

Figure 24A:
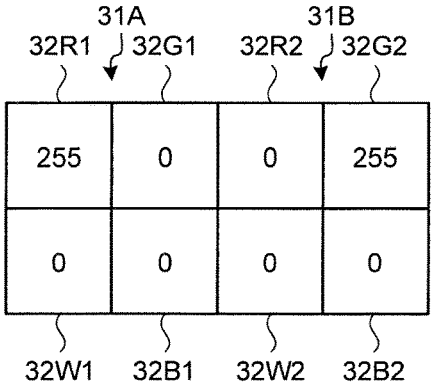
FIG. 24A is an explanatory diagram of color conversion in the image display device according to the embodiment.
Figure 24B:
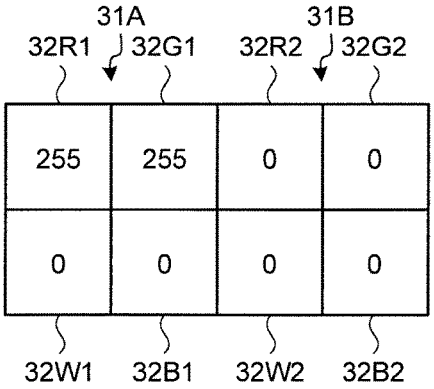
FIG. 24B is an explanatory diagram of color conversion in the image display device according to the embodiment.
Figure 24C:
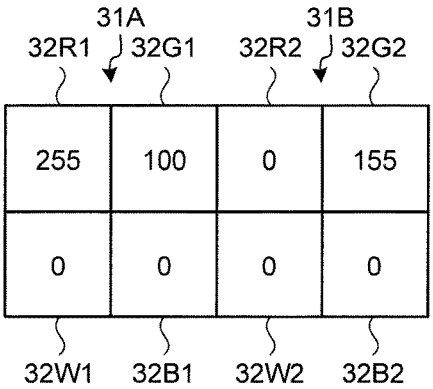
FIG. 24C is an explanatory diagram of color conversion in the image display device according to the embodiment.

Next, as illustrated in FIG. 24A, the following describes a case in which the input image signal corresponding to the first pixel 31A is represented as (R, G, B)=(255, 0, 0), and the input image signal corresponding to the second pixel 31B adjacent to the first pixel 31A is represented as (R, G, B)=(0, 255, 0). In this case, the signal processing unit 21 can output the input image signal using the first sub-pixel 32R1 of the first pixel 31A, but cannot output the input image signal using the sixth sub-pixel 32G2 of the second pixel 31B. In this case, to perform color conversion, as illustrated in FIG. 24B, the signal processing unit 21 causes the green component of the input image signal of the second pixel 31B that cannot be represented by the second pixel 31B to be included in the input image signal of the first pixel 31A, and simply converts it into the input image signal (R, G, B)=(255, 255, 0) with respect to the first pixel 31A. Subsequently, the signal processing unit 21 performs color conversion by causing part of the green component of the input image signal obtained by the above simple conversion with respect to the first pixel 31 to be included in the input image signal of the second pixel 31B so that the lighting quantity of the second sub-pixel 32G1 of the first pixel 31A is smaller than that of the sixth sub-pixel 32G2 of the second pixel 31B. As a result, as illustrated in FIG. 24C, the component of the first pixel 31A is represented as (R, G, B)=(255, 100, 0), and the component of the second pixel 31B is represented as (R, G, B)=(0, 155, 0). In this case, the signal processing unit 21 may directly perform color conversion without causing the green component of the input image signal of the second pixel 31B to be included in the input image signal of the first pixel 31A. Accordingly, the input image signal can be output by lighting the sixth sub-pixel 32G2 the power consumption of which is smaller than that of the second sub-pixel 32G1 while the lighting quantity of the second sub-pixel 32G1 is reduced, so that the power consumption of the image display device 100 can be reduced. The input image can be expressed by using each green sub-pixel of the first pixel 31A and the second pixel 32B, which can maintain the resolution of the image.

Figure 25A:
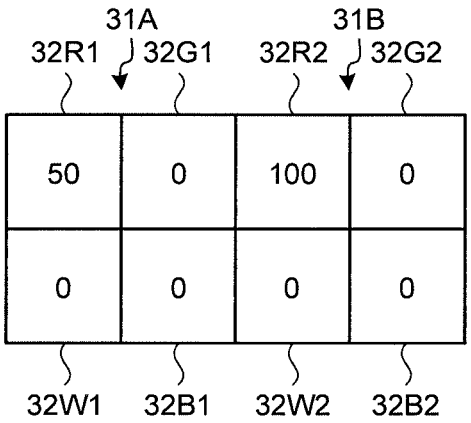
FIG. 25A is an explanatory diagram of color conversion in the image display device according to the embodiment.
Figure 25B:
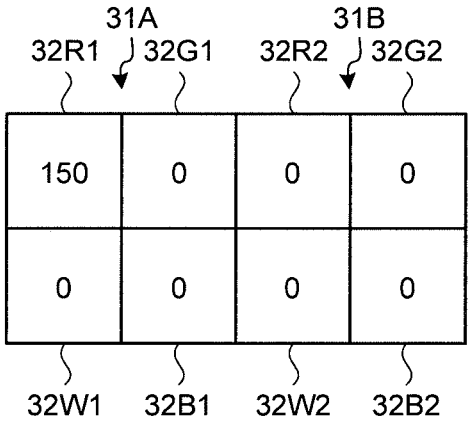
FIG. 25B is an explanatory diagram of color conversion in the image display device according to the embodiment.
Figure 25C:
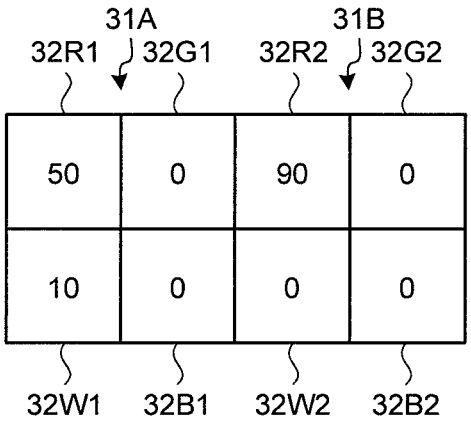
FIG. 25C is an explanatory diagram of color conversion in the image display device according to the embodiment.
Figure 25D:
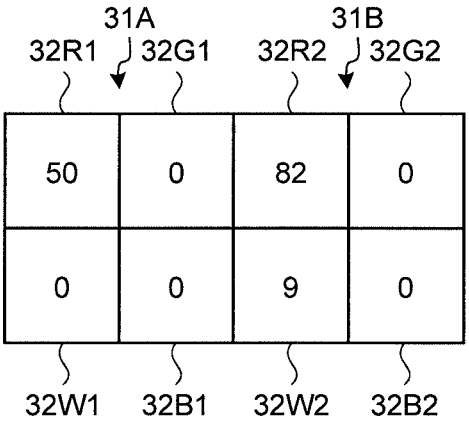
FIG. 25D is an explanatory diagram of color conversion in the image display device according to the embodiment.

Next, as illustrated in FIG. 25A, the following describes a case in which the input image signal corresponding to the first pixel 31A is represented as (R, G, B)=(50, 0, 0), and the input image signal corresponding to the second pixel 31B adjacent to the first pixel 31A is represented as (R, G, B)=(100, 0, 0). In this case, the signal processing unit 21 can output the input image signal using the first sub-pixel 32R1 of the first pixel 31A and the fifth sub-pixel 32R2 of the second pixel 31B. In this case, to perform color conversion, as illustrated in FIG. 25B, the signal processing unit 21 performs saturation conversion and simple conversion that causes the red component of the input image signal of the second pixel 31B to be included in the input image signal of the first pixel 31A, which generates the input image signal of (R, G, B)=(150, 0, 0) with respect to the first pixel 31A. In this case, the color component of the first pixel 31A on data is represented as (R, G, B)=(150, 10, 10). Subsequently, the signal processing unit 21 causes part of the red component of the input image signal obtained by the above simple conversion with respect to the first pixel 31 to be included in the input image signal of the second pixel 31B and to be converted into the fourth sub-pixel 32W1 of the first pixel 31A so that each of the first pixel 31A and the second pixel 31B comes closer to the color component of the input image signal. As a result, as illustrated in FIG. 25C, the component of the first pixel 31A is represented as (R, G, B, W)=(50, 0, 0, 10), and the component of the second pixel 31B is represented as (R, G, B, W)=(90, 0, 0, 0). As a result, the luminance of the first sub-pixel 32R1 of the first pixel 31A is equal to the luminance of the fifth sub-pixel 32R2 of the second pixel 31B on data. Next, the signal processing unit 21 adjusts the luminance by causing the white component of the color-converted input image signal with respect to the first pixel 31A to be included in the input image signal of the second pixel 31B so that the luminance of the second pixel 31B is combined with the luminance of the first pixel 31A. As a result, as illustrated in FIG. 25D, the component of the first pixel 31A is represented as (R, G, B, W)=(50, 0, 0, 0), and the component of the second pixel 31B is represented as (R, G, B, W)=(82, 0, 0, 9). Accordingly, the hue and the saturation of the image data can be arbitrarily adjusted according to the luminance of the input image.

Figure 26A:
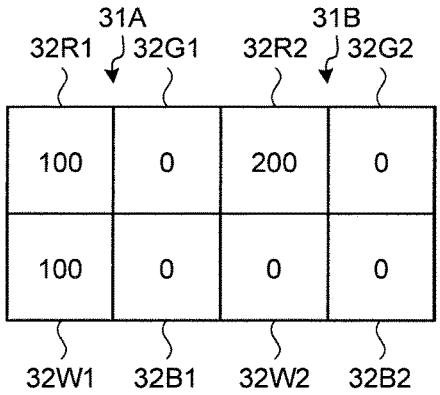
FIG. 26A is an explanatory diagram of color conversion in the image display device according to the embodiment.
Figure 26B:
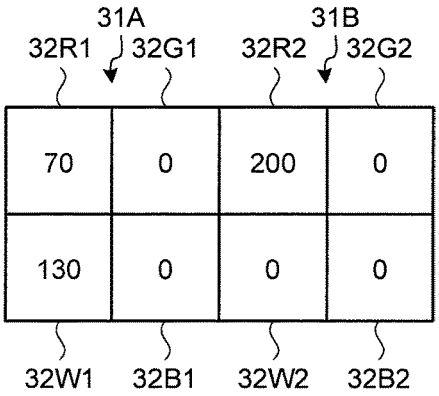
FIG. 26B is an explanatory diagram of color conversion in the image display device according to the embodiment.
Figure 26C:
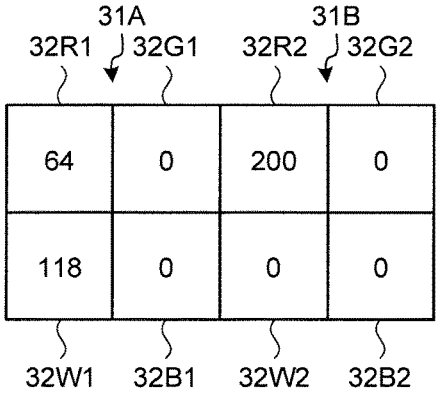
FIG. 26C is an explanatory diagram of color conversion in the image display device according to the embodiment.

Next, as illustrated in FIG. 26A, the following describes a case in which the input image signal corresponding to the first pixel 31A is represented as (R, G, B, W)=(100, 0, 0, 100), and the input image signal corresponding to the second pixel 31B adjacent to the first pixel 31A is represented as (R, G, B, W)=(200, 0, 0, 0). In this case, the signal processing unit 21 can express the input image signal using the first sub-pixel 32R1 for the first pixel 31A, but cannot express the input image signal using the fifth sub-pixel 32R2 for the second pixel 31B. As illustrated in FIG. 26B, the signal processing unit 21 then performs color conversion for causing the red component of the input image signal of the first pixel 31A to be included in the input image signal of the second pixel 31B, causing the white component of the input image signal of the second pixel 31B to be included in the input image signal of the first pixel 31A to light the red component of the second pixel 31B, and causing the lighting quantity of the white component of the first pixel 31A to increase so as to compensate the lighting quantity of the red component of the first pixel 31A. As a result, as illustrated in FIG. 26B, the component of the first pixel 31A is represented as (R, G, B, W)=(70, 0, 0, 130), and the component of the second pixel 31B is represented as (R, G, B, W)=(200, 0, 0, 0). Subsequently, the signal processing unit 21 adjusts the luminance by causing the white component of the color-converted input image signal with respect to the first pixel 31A to be included in the input image signal of the second pixel 31B so that the luminance of the second pixel 31B is combined with the luminance of the first pixel 31A. As a result, as illustrated in FIG. 26C, the component of the first pixel 31A is represented as (R, G, B, W)=(64, 0, 0, 118), and the component of the second pixel 31B is represented as (R, G, B, W)=(200, 0, 0, 0). Accordingly, the hue and the saturation of the image data can be arbitrarily adjusted according to the luminance of the input image.

When there are a plurality of combinations of the output of the sub-pixels 32 of the first pixel 31A and the output of the sub-pixels 32 of the second pixel 31B adjacent to the first pixel 31A based on the input image signals corresponding to adjacent two pixels, that is, the first pixel 31A and the second pixel 31B, the signal processing unit 21 may perform output according to the output of the sub-pixels 32 of the first pixel 31A and the input image signal of the sub-pixels 32 of the second pixel 31B by which the luminance distribution of the first pixel 31A approximates to the luminance distribution of the second pixel 31B. For example, assume that when the number of sub-pixels 32 to be lit in the first pixel 31A is contrasted with the number of sub-pixels 32 to be lit in the second pixel 31B as (A:B), (A:B)=(a:b) is established with the component of the input image signal preferentially converted into the white component, and (A:B)=(c:d) is established with the component of the input image signal preferentially converted into the component other than white. The output may be performed according to a smaller value of an absolute value of a difference between a and b and that of a difference between c and d. That is, when the difference in the number of sub-pixels 32 to be lit in the pixels is smaller, the luminance distributions of the respective pixels approximate to each other in the output result, which can prevent luminance deviation. The signal processing unit 21 may perform output according to the output of the sub-pixels 32 of the first pixel 31A and the input image signal of the sub-pixels 32 of the second pixel 31B by which the luminance distribution of the first pixel 31A approximates to the luminance distribution of the second pixel 31B based on the arrangement of the sub-pixels 32 to be lit in each pixel and intensity of the outputs of the sub-pixels 32 to be lit. When there is an edge in the input image, the signal processing unit 21 may perform color conversion between adjacent pixels so as to eliminate the edge. Due to the edge, the boundary of colors can be recognized to be apparently present between the adjacent pixels because at least one of the hue, the saturation, and the luminance is largely different between the adjacent pixels. For example, the edge means a boundary between a character, a line, or a figure of white or another color and a background of black (or vice versa).

APPLICATION EXAMPLE

Figure 27:
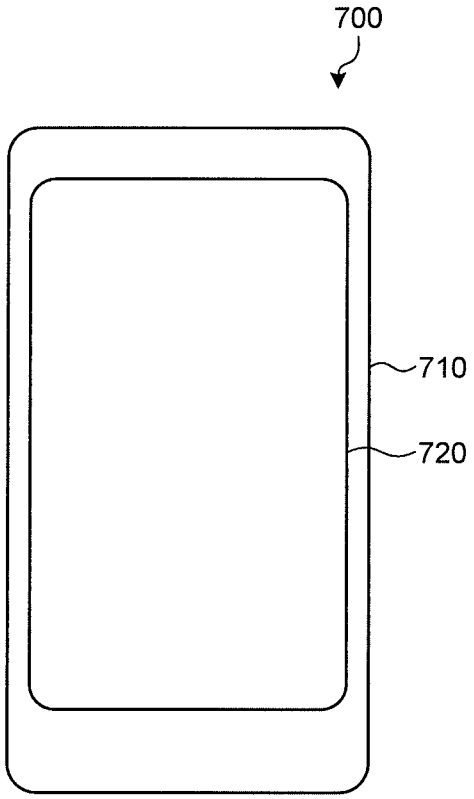
FIG. 27 is a diagram illustrating an example of an external appearance of a smartphone to which the present invention is applied.

Next, the following describes an application example of the image display device described in the above embodiment with reference to FIG. 27. The image display device described in the above embodiment can be applied to electronic apparatuses in various fields such as a smartphone. In other words, such an image display device can be applied to electronic apparatuses in various fields that display, as an image or video, a video signal input from the outside or a video signal generated inside.

FIG. 27 is a diagram illustrating an example of an external appearance of a smartphone 700 to which the present invention is applied. The smartphone 700 includes a display unit 720 arranged on one surface of a housing 710 thereof, for example. The display unit 720 is constituted of the image display device according to the present invention.

As described above, according to the embodiment, arranged is the second pixel including the sub-pixels having the luminance higher than that of the sub-pixels included in the first pixel. That is, power consumption in lighting the sub-pixels included in the second pixel can be reduced as compared with a case in which the sub-pixels are common to all the pixels. Due to this, the power consumption of the display device can be suppressed without increasing pixel density. The signal processing unit performs color conversion, between the adjacent first pixel and second pixel, on the first component of the input image signal corresponding to the first pixel and the second component of the input image signal corresponding to the second pixel adjacent to the first pixel. Accordingly, the sub-pixels of the second pixel having higher luminance can be preferentially lit, so that the power consumption can be further reduced and the resolution of the image can be prevented from being reduced.

Each of the first pixel and the second pixel includes the white sub-pixel, and the outputs of white and the luminance for each pixel thus can be handled irrespective of whether the pixel to which the input image signal is input is the first pixel or the second pixel. Accordingly, resolution related to brightness of each pixel in a display output (image) output from the image display unit 30 can be secured with granularity of the pixel 31. That is, the resolution can be secured. When the white sub-pixel is lit in a case in which there is a component that can be converted into white among the components of the input image signal, the luminance of each pixel can be secured with the lit white sub-pixel. That is, in view of securing the luminance, the output of the sub-pixels of other colors can be further suppressed, so that a power-saving property at a higher level can be obtained.

When the arrangement of the white sub-pixel in the first pixel is the same as the arrangement of the white sub-pixel in the second pixel, the resolution of the image to be obtained with the white sub-pixel can be obtained from a more regular arrangement of the white sub-pixel. Accordingly, a display output having a better appearance can be obtained.

When there are a plurality of combinations of the output of the sub-pixels of the first pixel and the output of the sub-pixels of the second pixel adjacent to the first pixel based on the respective input image signals corresponding to the first pixel and the second pixel that are adjacent to each other, the luminance distribution of each pixel can be balanced by performing output of the sub-pixels of the first pixel and the output of the sub-pixels of the second pixel so that the luminance distribution of the first pixel approximates to the luminance distribution of the second pixel. Accordingly, a display output having a better appearance can be obtained.

When the number of the sub-pixels included in the first pixel is the same as the number of the sub-pixels included in the second pixel, and the sub-pixels in the first pixel and the sub-pixels in the second pixel are arranged so that hue arrangements in the respective pixels approximate to each other when the hue of the sub-pixels included in the first pixel is compared with the hue of the sub-pixels included in the second pixel, unevenness of colors in the display area constituted by the respective colors of the sub-pixels can be more flattened.

When the number of the sub-pixels included in the first pixel is the same as the number of the sub-pixels included in the second pixel, and the sub-pixels in the first pixel and the sub-pixels in the second pixel are arranged so that high and low relations of the luminance are the same between the sub-pixels in the respective pixels, unevenness of the luminance in the display area constituted by the respective colors of the sub-pixels can be more flattened.

When the display area has linear sides and the pixels adjacent to at least one side are the first pixels, the first pixel that performs color expression cooperating with the second pixel adjacent to the side can be more securely secured.

When the second pixels are arranged in a staggered manner, the number of the first pixels adjacent to the second pixels can be increased. Accordingly, the first pixel that performs color expression cooperating with the second pixel can be more securely secured.

An organic EL display device has been disclosed as an example. As other application examples, exemplified are various image display devices of flat-panel type such as other self-luminous display devices, liquid crystal display devices, or electronic paper display devices including an electrophoresis element and the like. Obviously, the size of the device is not limited, and the present invention can be applied to any of small, medium, and large devices.

The present disclosure includes the following aspects.

(1) An image display device comprising:

first pixels each including sub-pixels of three or more colors included in a first color gamut;

second pixels each including sub-pixels of three or more colors, the sub-pixels in the second pixels having luminance higher than the luminance of the sub-pixels in the first pixels, the three or more colors belonging to a second color gamut within the first color gamut; and an image display unit in which the first pixels and the second pixels are arranged in a matrix in a display area, the first pixels and the second pixels being adjacent to each other.

(2) The image display device according to (1), wherein the first pixels and the second pixels each include a white sub-pixel.

(3) The image display device according to (2), wherein an arrangement of the white sub-pixel in each of the first pixels is the same as an arrangement of the white sub-pixel in each of the second pixels.

(4) The image display device according to (1), wherein three colors among colors of the sub-pixels included in each of the first pixels correspond to red, green, and blue, the display area has linear sides, and at least one side is adjacent to the first pixels.

(5) The image display device according to (4), wherein the second pixels are arranged in a staggered manner.

(6) An image display device comprising:

first pixels each including sub-pixels of three or more colors included in a first color gamut;

second pixels each including sub-pixels of three or more colors, the sub-pixels in the second pixels having luminance higher than the luminance of the sub-pixels in the first pixels, the three or more colors being included in a second color gamut within the first color gamut;

an image display unit in which the first pixels and the second pixels are arranged in a matrix, the first pixels and the second pixels being adjacent to each other; and a signal processing unit that determines an output of the sub-pixels included in each pixel of the image display unit according to an input image signal.

(7) The image display device according to (6), wherein when a second component that is a component of an input image signal corresponding to one of the second pixels is a component within the second color gamut, the signal processing unit determines the output of the sub-pixels included in one of the first pixels based on a first component that is a component of the input image signal corresponding to the first pixel, and the signal processing unit determines the output of the sub-pixels included in the second pixel based on the second component that is a component of the input image signal corresponding to the second pixel.

(8) The image display device according to (6) or (7), wherein the signal processing unit performs, between adjacent first and second pixels, color conversion on the first component that is a component of the input image signal of the first pixel and the second component that is a component of the input image signal corresponding to the second pixel, and determines the output of the sub-pixels included in the first pixel and the output of the sub-pixels included in the second pixel.

(9) The image display device according to (6) or (7), wherein when the second component that is a component of the input image signal corresponding to the second pixel includes a component outside the second color gamut, the signal processing unit performs, between adjacent first and second pixels, color conversion on the first component that is a component of the input image signal corresponding to the first pixel and the second component that is a component of the input image signal corresponding to the second pixel, and determines the output of the sub-pixels included in the second pixel based on the color-converted second component.

(10) The image display device according to any one of (6) to (9), wherein the first pixels and the second pixels each include a white sub-pixel, and when there is a component that can be converted into white among components of the input image signal, the signal processing unit determines outputs of the first and the second pixels so that at least one of the white sub-pixels of the first and second pixels is lit.

(11) The image display device according to (10), wherein an arrangement of the white sub-pixel in each of the first pixels is the same as an arrangement of the white sub-pixel in each of the second pixels.

(12) The image display device according to any one of (6) to (8), wherein, when there are a plurality of combinations of the output of the sub-pixels of one of the first pixels and the output of the sub-pixels of a second pixel adjacent to the first pixel based on the input image signals corresponding to the adjacent first and second pixels, the signal processing unit performs output of the sub-pixels of the first pixel and output of the sub-pixels of the second pixel so that luminance distribution of the first pixel approximates to luminance distribution of the second pixel.

(13) The image display device according to any one of (6) to (8), wherein the number of sub-pixels included in each of the first pixels is the same as the number of sub-pixels included in each of the second pixels, and the sub-pixels in the first pixels and the sub-pixels in the second pixels are arranged so that rotation directions of hues in each pixel are the same when the hues of the sub-pixels included in the first pixels are contrasted with the hues of the sub-pixels included in the second pixels.

What is claimed is:

1. An image display device comprising:

first pixels each including sub-pixels of three or more colors included in a first color gamut;

second pixels each including sub-pixels of three or more colors, the sub-pixels in the second pixels having luminance higher than the luminance of the sub-pixels in the first pixels, the three or more colors belonging to a second color gamut within the first color gamut; and an image display unit in which the first pixels and the second pixels are arranged in a matrix in a display area, the first pixels and the second pixels being adjacent to each other, wherein the first pixels include a first sub-pixel, a second sub-pixel and a third sub-pixel, the second pixels include a fourth sub-pixel, a fifth sub-pixel and a sixth sub-pixel, the luminance of the fourth sub-pixel is higher than that of the first sub-pixel, the luminance of the fifth sub-pixel is higher than that of the second sub-pixel, and the luminance of the sixth sub-pixel is higher than that of the third sub-pixel, a first color filter, a second color filter, a third color filter, a fourth color filter, a fifth color filter, and a sixth color filter are arranged corresponding to the first sub-pixel, the second sub-pixel, the third sub-pixel, the fourth sub-pixel, the fifth sub-pixel and the sixth sub-pixel, respectively, and transmittance of the fourth color filter is higher than transmittance of the first color filter, transmittance of the fifth color filter is higher than transmittance of the second color filter, and transmittance of the sixth color filter is higher than transmittance of the third color filter.

2. The image display device according to claim 1, wherein the first pixels and the second pixels each include a white sub-pixel.

3. The image display device according to claim 2, wherein an arrangement of the white sub-pixel in each of the first pixels is the same as an arrangement of the white sub-pixel in each of the second pixels.

4. The image display device according to claim 1, wherein three colors among colors of the sub-pixels included in each of the first pixels correspond to red, green, and blue, the display area has linear sides, and at least one side is adjacent to the first pixels.

5. The image display device according to claim 4, wherein the second pixels are arranged in a staggered manner.

6. An image display device comprising:

first pixels each including sub-pixels of three or more colors included in a first color gamut;

second pixels each including sub-pixels of three or more colors, the sub-pixels in the second pixels having luminance higher than the luminance of the sub-pixels in the first pixels, the three or more colors being included in a second color gamut within the first color gamut;

an image display unit in which the first pixels and the second pixels are arranged in a matrix, the first pixels and the second pixels being adjacent to each other; and processing circuitry configured to determine an output of the sub-pixels included in each pixel of the image display unit according to an input image signal, wherein the first pixels include a first sub-pixel, a second sub-pixel and a third sub-pixel, the second pixels include a fourth sub-pixel, a fifth sub-pixel and a sixth sub-pixel, the luminance of the fourth sub-pixel is higher than that of the first sub-pixel, the luminance of the fifth sub-pixel is higher than that of the second sub-pixel, and the luminance of the sixth sub-pixel is higher than that of the third sub-pixel, a first color filter, a second color filter, a third color filter, a fourth color filter, a fifth color filter, and a sixth color filter are arranged corresponding to the first sub-pixel, the second sub-pixel, the third sub-pixel, the fourth sub-pixel, the fifth sub-pixel and the sixth sub-pixel, respectively, and transmittance of the fourth color filter is higher than transmittance of the first color filter, transmittance of the fifth color filter is higher than transmittance of the second color filter, and transmittance of the sixth color filter is higher than transmittance of the third color filter.

7. The image display device according to claim 6, wherein when a second component of the input image signal corresponding to one of the second pixels is a component within the second color gamut, the processing circuitry determines the output of the sub-pixels included in one of the first pixels based on a first component of the input image signal corresponding to the first pixel, and the processing circuitry determines the output of the sub-pixels included in the second pixel based on the second component of the input image signal corresponding to the second pixel.

8. The image display device according to claim 6, wherein the processing circuitry performs, between adjacent first and second pixels, color conversion on a first component of the input image signal of the first pixel and a second component of the input image signal corresponding to the second pixel, and determines the output of the sub-pixels included in the first pixel and the output of the sub-pixels included in the second pixel.

9. The image display device according to claim 6, wherein when a second component of the input image signal corresponding to the second pixel includes a component outside the second color gamut, the processing circuitry performs, between adjacent first and second pixels, color conversion on a first component of the input image signal corresponding to the first pixel and the second component of the input image signal corresponding to the second pixel, and determines the output of the sub-pixels included in the second pixel based on the color-converted second component.

10. The image display device according to claim 6, wherein the first pixels and the second pixels each include a white sub-pixel, and when there is a component that can be converted into white among components of the input image signal, the processing circuitry determines outputs of the first and the second pixels so that at least one of the white sub-pixels of the first and second pixels is lit.

11. The image display device according to claim 10, wherein an arrangement of the white sub-pixel in each of the first pixels is the same as an arrangement of the white sub-pixel in each of the second pixels.

12. The image display device according to claim 6, wherein, when there are a plurality of combinations of the output of the sub-pixels of one of the first pixels and the output of the sub-pixels of a second pixel adjacent to the first pixel based on the input image signals corresponding to the adjacent first and second pixels, the processing circuitry performs output of the sub-pixels of the first pixel and output of the sub-pixels of the second pixel so that luminance distribution of the first pixel approximates to luminance distribution of the second pixel.

13. The image display device according to claim 6, wherein the number of sub-pixels included in each of the first pixels is the same as the number of sub-pixels included in each of the second pixels, and the sub-pixels in the first pixels and the sub-pixels in the second pixels are arranged so that rotation directions of hues in each pixel are the same when the hues of the sub-pixels included in the first pixels are contrasted with the hues of the sub-pixels included in the second pixels.

* * * * *